US005135437A

United States Patent [19]

Schubert

[11] Patent Number: 5,135,437

[45] Date of Patent: Aug. 4, 1992

[54] FORM FOR MAKING TWO-SIDED CARBONLESS COPIES OF INFORMATION ENTERED ON BOTH SIDES OF AN ORIGINAL SHEET AND METHODS OF MAKING AND USING SAME

[76] Inventor: Keith E. Schubert, 4 Timothy Rd., W. Norwalk, Conn. 06850

[21] Appl. No.: 723,690

[22] Filed: Jun. 24, 1991

Related U.S. Application Data

[63] Continuation of Ser. No. 484,686, Feb. 23, 1990, abandoned, which is a continuation-in-part of Ser. No. 436,189, Nov. 13, 1989, which is a continuation-in-part of Ser. No. 334,183, Apr. 6, 1989.

[51] Int. Cl.[5] ..... B41L 1/20

[52] U.S. Cl. ..... 462/8; 402/25; 402/84; 402/19

[58] Field of Search ..... 283/116; 462/2, 8, 7, 462/17, 19, 18, 23, 25, 84; 503/205, 226

[56] References Cited

U.S. PATENT DOCUMENTS

| | | | |
|---|---|---|---|
| Re. 30,041 | 7/1979 | Maalouf | 282/27.5 |
| Re. 30,116 | 10/1979 | Maalouf | 282/27.5 |
| Re. 31,695 | 10/1984 | Zink | 427/211 |
| 371,126 | 10/1887 | Currie . | |
| 396,560 | 1/1889 | Harrison et al. . | |
| 418,455 | 12/1889 | Gray . | |
| 419,359 | 1/1890 | Rogers . | |
| 445,368 | 1/1891 | Campbell . | |
| 664,384 | 12/1900 | Cooke . | |
| 683,782 | 10/1901 | Morland . | |
| 756,258 | 4/1904 | Mallin . | |

(List continued on next page.)

FOREIGN PATENT DOCUMENTS

| | | |
|---|---|---|
| 549442 | 4/1932 | Fed. Rep. of Germany . |
| 613658 | 3/1926 | France . |
| 128558 | 2/1962 | New Zealand . |
| 128915 | 3/1964 | New Zealand . |
| 185282 | 11/1980 | New Zealand . |
| 1347807 | 2/1974 | United Kingdom . |
| 2085359 | 4/1982 | United Kingdom . |

OTHER PUBLICATIONS

Black Clawson Brochure.
"Flip-N-Rite", 7-page instructions by Gary Thompson.
FORM Magazine, Feb., 1989, pp. 74–80.
Business Forms Labels & Systems, Jul. 1990, p. 48.
"Pressure Sensitive Papers", Project 2558, No. 222, TAPPI Coating Committee, 1965.
"Pressure Sensitive Papers", Project 2558, TAPPI Coating Committee, Dec., 1967.
Facsimiles of BH Medical, MAP Phone Message, Moore Two-Way Rite, St. Vincent Medical Center, Maybelline and Hartz Mountain forms.

*Primary Examiner*—Paul A. Bell
*Attorney, Agent, or Firm*—Gerald E. Linden

[57] ABSTRACT

The carbonless copy form of this invention reproduces information written or printed on both the front and back surfaces of an "original" page onto the two (front and back) surfaces of a "copy" page. In one embodiment, the form is formed of a single sheet of paper comprising a clear (uncoated) original page and a copy pages coated with carbonless CF treatment on both sides. A separate intermediate sheet, coated with carbonless CB treatment on at least one side is interposed between the folded and refolded original copy pages to effect reproduction of information entered on the front and back surfaces of the original page onto the back and front surfaces, respectively, of the copy page. In other embodiments, the original, copy and intermediate pages are formed from a single sheet of paper. The original page is clear, the copy page is CF-coated on both sides and the intermediate page is CB-coated on both sides. Various positionings and foldings of the original, copy and intermediate pages are disclosed for effecting reproduction of information entered on both sides of the original page onto both sides of the copy page. Methods of using the carbonless forms are disclosed.

16 Claims, 10 Drawing Sheets

U.S. PATENT DOCUMENTS

| | | | |
|---|---|---|---|
| 765,408 | 7/1904 | Wildey . | |
| 797,302 | 8/1905 | Meacham . | |
| 897,783 | 9/1908 | Reynolds . | |
| 971,283 | 9/1910 | Krueger . | |
| 972,549 | 10/1910 | Lewis . | |
| 1,101,262 | 6/1914 | Edmonds . | |
| 1,187,682 | 6/1916 | Trueman | 282/12 |
| 1,301,834 | 4/1919 | Gilman . | |
| 1,392,748 | 10/1921 | Davidson . | |
| 1,468,094 | 9/1923 | Wherry . | |
| 1,873,997 | 8/1932 | Davis . | |
| 1,980,318 | 11/1934 | Caton . | |
| 1,980,319 | 11/1934 | Caton . | |
| 2,006,034 | 6/1935 | Stevens . | |
| 2,035,768 | 3/1936 | Sherman et al. | 91/68 |
| 2,084,221 | 6/1937 | Schutz | 282/28 |
| 2,093,086 | 9/1937 | Luzzatto | 282/27 |
| 2,098,706 | 11/1937 | Lawson et al. | 282/12 |
| 2,118,888 | 5/1938 | Lewis et al. | 101/131 |
| 2,131,381 | 9/1938 | Linderman | 282/28 |
| 2,148,886 | 2/1939 | Wanser | 229/69 |
| 2,168,098 | 8/1939 | Groak | 282/26 |
| 2,194,670 | 3/1940 | Neu | 282/27 |
| 2,211,532 | 8/1940 | Biggs | 282/12 |
| 2,220,842 | 11/1940 | Hano | 282/12 |
| 2,226,722 | 12/1940 | Jones | 282/22 |
| 2,257,766 | 10/1941 | Sherman | 282/3 |
| 2,262,347 | 11/1941 | Sturc | 282/26 |
| 2,264,119 | 11/1941 | Lichter | 283/1 |
| 2,327,215 | 8/1943 | Potter | 282/12 |
| 2,458,729 | 1/1949 | Politzer | 40/102 |
| 2,470,586 | 5/1949 | Tathwell | 282/9 |
| 2,503,680 | 4/1950 | Newman | 282/19 |
| 2,548,366 | 4/1951 | Green et al. | 282/28 |
| 2,550,466 | 4/1951 | Green et al. | 282/28 |
| 2,550,468 | 4/1951 | Green et al. | 282/28 |
| 2,550,469 | 4/1951 | Green et al. | 282/28 |
| 2,606,775 | 8/1952 | Newman | 282/28 |
| 2,618,573 | 11/1952 | Green | 117/36 |
| 2,637,571 | 5/1953 | Tilly | 281/5 |
| 2,694,429 | 11/1954 | Berger | 150/39 |
| 2,712,507 | 7/1955 | Green | 117/36 |
| 2,802,678 | 8/1957 | Bright | 282/22 |
| 2,869,898 | 1/1959 | Martin . | |
| 2,870,040 | 1/1959 | Gill | 117/36 |
| 2,907,585 | 10/1959 | Sornberger | 282/22 |
| 2,980,447 | 4/1961 | Weger | 282/22 |
| 3,016,308 | 1/1962 | Macaulay | 117/36.7 |
| 3,104,799 | 9/1963 | Steidinger | 229/69 |
| 3,364,052 | 1/1968 | Martino | 117/15 |
| 3,376,154 | 4/1968 | Campbell et al. | 117/364 |
| 3,429,827 | 2/1969 | Ruus | 252/316 |
| 3,481,759 | 12/1969 | Ostlie | 117/36.2 |
| 3,539,375 | 11/1970 | Baum | 117/36.2 |
| 3,625,547 | 12/1971 | Burke | 282/23 |
| 3,682,681 | 8/1972 | Kunkel | 117/36.2 |
| 3,769,057 | 10/1973 | Lin | 117/36.2 |
| 3,769,062 | 10/1973 | Ishige et al. | 117/36.2 |
| 3,825,467 | 7/1974 | Phillips, Jr. | 161/159 |
| 3,854,654 | 12/1974 | Van Malderghem | 229/69 |
| 3,902,655 | 9/1975 | Huffman | 229/69 |
| 3,908,063 | 9/1975 | Rosendale et al. | 428/320 |
| 3,945,870 | 3/1976 | Johnsen | 156/201 |
| 3,955,750 | 5/1976 | Huffman | 229/69 |
| 3,963,853 | 6/1976 | Hughes et al. | 428/326 |
| 3,968,299 | 7/1976 | Angleman | 428/307 |
| 3,981,523 | 9/1976 | Maalouf | 282/27.5 |
| 3,988,971 | 11/1976 | Steidinger | 93/63 M |
| 3,996,406 | 12/1976 | Alsop | 428/307 |
| 4,000,916 | 1/1977 | Lucas | 282/11.5 |
| 4,036,511 | 7/1977 | Maalouf | 282/27.5 |
| 4,039,046 | 7/1977 | D'Luhy | 282/22 R |
| 4,045,053 | 8/1977 | Carriere | 282/22 R |
| 4,046,404 | 9/1977 | Treier | 282/27.5 |
| 4,056,191 | 11/1977 | Weisenfluh | 206/629 |
| 4,062,567 | 12/1977 | Macaulay | 282/27.5 |
| 4,063,754 | 12/1977 | Shackle et al. | 282/27.5 |
| 4,081,127 | 3/1978 | Steidinger | 229/69 |
| 4,081,188 | 3/1978 | Westcott | 282/27.5 |
| 4,091,122 | 5/1978 | Davis et al. | 427/44 |
| 4,095,695 | 6/1978 | Steidinger | 206/620 |
| 4,097,619 | 6/1978 | Davis et al. | 427/44 |
| 4,111,461 | 9/1978 | Levensalor | 282/27.5 |
| 4,112,138 | 9/1978 | Davis et al. | 427/54 |
| 4,113,281 | 9/1978 | Halse | 282/11.5 A |
| 4,121,857 | 10/1978 | Halse | 282/11.5 A |
| 4,126,334 | 11/1978 | Van Malderghem | 282/22 R |
| 4,137,343 | 1/1979 | Davis et al. | 427/150 |
| 4,138,302 | 2/1979 | D'Luhy | 156/216 |
| 4,139,218 | 2/1979 | Davis et al. | 282/27.5 |
| 4,139,392 | 2/1979 | Davis et al. | 106/14.5 |
| 4,143,890 | 3/1979 | Davis et al. | 282/27.5 |
| 4,143,891 | 3/1979 | Neubauer | 282/27.5 |
| 4,165,101 | 8/1979 | Sternberg | 282/27.5 |
| 4,168,851 | 9/1979 | Halse | 282/11.5 A |
| 4,172,605 | 10/1979 | Welsch et al. | 282/27.5 |
| 4,178,018 | 12/1979 | Halse | 282/11.5 A |
| 4,198,446 | 4/1980 | Goetz | 427/150 |
| 4,199,174 | 4/1980 | Sornberger | 282/27.5 |
| 4,203,619 | 5/1980 | Sanders | 282/27.5 |

(List continued on next page.)

U.S. PATENT DOCUMENTS

| | | | |
|---|---|---|---|
| 4,208,460 | 6/1980 | Knechtle et al. | 428/195 |
| 4,217,162 | 8/1980 | Glanz et al. | 156/305 |
| 4,282,275 | 8/1981 | Werner | 427/428 |
| 4,336,067 | 6/1982 | Shackle et al. | 106/21 |
| 4,343,494 | 8/1982 | Ehrhardt et al. | 282/27.5 |
| 4,352,855 | 10/1982 | Hiraishi et al. | 428/320.4 |
| 4,354,449 | 10/1982 | Zink | 118/126 |
| 4,361,108 | 11/1982 | Robillard et al. | 118/265 |
| 4,381,120 | 4/1983 | Golden | 282/27.5 |
| 4,397,483 | 8/1983 | Hiraishi et al. | 282/27.5 |
| 4,407,524 | 10/1983 | Trautlein | 282/9 R |
| 4,425,386 | 1/1984 | Chang | 427/256 |
| 4,448,445 | 5/1984 | Chang et al. | 346/206 |
| 4,455,327 | 6/1984 | Yoshida | 427/131 |
| 4,501,559 | 2/1985 | Griswold et al. | 434/154 |
| 4,512,595 | 4/1985 | Breen | 283/70 |
| 4,533,160 | 8/1985 | Malone | 282/23 R |
| 4,556,390 | 12/1985 | Rahn et al. | 434/433 |
| 4,566,720 | 1/1986 | Goldman et al. | 281/15 R |
| 4,576,399 | 3/1986 | White et al. | 282/8 R |
| 4,583,765 | 4/1986 | Messinger | 282/9 R |
| 4,593,935 | 6/1986 | Kearns | 282/28 R |
| 4,597,993 | 7/1986 | Okada et al. | 427/150 |
| 4,614,362 | 9/1986 | Breen et al. | 282/9 R |
| 4,614,363 | 9/1986 | Breen | 282/22 R |
| 4,636,818 | 1/1987 | Jerabek | 346/213 |
| 4,642,662 | 2/1987 | Torii et al. | 346/215 |
| 4,657,783 | 4/1987 | Tatt et al. | 427/211 |
| 4,690,433 | 9/1987 | Showers et al. | 283/1 |
| 4,715,620 | 12/1987 | Thompson | 282/9 R |
| 4,722,553 | 2/1988 | Evans | 282/9 R |
| 4,740,015 | 4/1988 | Caprio et al. | 283/70 |
| 4,745,097 | 5/1988 | Maekawa et al. | 503/209 |
| 4,762,342 | 8/1988 | Thompson | 282/9 R |
| 4,814,319 | 3/1989 | Matsumoto et al. | 503/216 |
| 4,846,594 | 7/1989 | Riskin | 400/188 |
| 4,853,364 | 8/1989 | Liang et al. | 503/216 |
| 4,859,561 | 8/1989 | Metz et al. | 430/138 |
| 4,871,193 | 10/1989 | Wörndli | 283/72 |
| 4,877,767 | 10/1989 | Liang et al. | 503/212 |
| 4,912,080 | 3/1990 | Weinstein | 503/200 |
| 4,935,401 | 6/1990 | Pendergrass, Jr. | 503/206 |
| 4,938,507 | 7/1990 | Ashby et al. | 282/9 R |
| 4,947,343 | 7/1990 | Amari | 364/518 |
| 4,957,380 | 9/1990 | Gerstle et al. | 400/279 |
| 4,959,343 | 9/1990 | Weinstein | 503/200 |
| 4,970,193 | 11/1990 | Liang et al. | 503/201 |
| 4,974,035 | 11/1990 | Rabb et al. | 355/320 |
| 4,977,060 | 12/1990 | Liang et al. | 430/138 |
| 4,977,131 | 12/1990 | Macaulay | 503/201 |
| 4,996,184 | 2/1991 | Bevan et al. | 503/226 |
| 5,002,311 | 3/1991 | Brunjes | 282/9 R |
| 5,004,271 | 4/1991 | Piatt | 283/65 |

FORM FOR MAKING TWO-SIDED CARBONLESS COPIES OF INFORMATION ENTERED ON BOTH SIDES OF AN ORIGINAL SHEET AND METHODS OF MAKING AND USING SAME

CROSS REFERENCE TO RELATED APPLICATIONS

This is a continuation of U.S. patent application Ser. No. 484,686, filed Feb. 23, 1990, now abandoned, which is a continuation-in-part of copending U.S. patent application Ser. No. 436,189, entitled filed Nov. 13, 1989 by Keith E. Schubert, which is a continuation-in-part of copending U.S. patent application Ser. No. 334,183, entitled filed Apr. 6, 1989 by Keith E. Schubert.

TECHNICAL FIELD OF THE INVENTION

The invention relates to carbonless copy paper technology and, more particularly, to techniques for producing a two-sided carbonless copy of both sides of an original page or form.

BACKGROUND OF THE INVENTION

Everyone who has used carbon paper for copying knows of its disadvantages. It smudges, it dirties the fingers, each sheet gradually deteriorates in efficiency, and it is time consuming to position the carbon paper accurately between the original and copy sheets. These factors led to the search for a substitute, and about 45 years ago, carbonless copy paper was developed.

Generally, in carbonless copy technology, the back surface (back side) of a top sheet of paper (the "original") is coated with a layer of microcapsules that contain a dye in colorless form in a hydrocarbon solvent. The coating on the back side of the top ("original") sheet is usually termed "CB" for carbonless back or coated back. Writing or printing pressure applied to the top surface (front side) of the top sheet breaks the capsules and releases the dye, which reacts with a clay or phenolic resin coating on the top surface (front side) of a second, underlying paper sheet (the "copy") located directly below the original sheet to produce a visible image of the writing or printing applied to the original on the copy. The coating on the front side of the copy sheet is usually termed "CF" for carbonless front or coated front.

One type of carbonless copy technology is typified by National Cash Register Company's NCR ("No Carbon Required") paper, which was introduced in 1954. NCR, or pressure-sensitive paper is based on the principle of coating the under surface (back side) of the top sheet of paper ("original") with a dried emulsion of colorless dye held in microcapsules which are ruptured by the force of writing or printing pressure applied to the front side of the sheet. The released dye is reacted with a reagent on the front surface of an underlying copy sheet which changes the dye to a colored (typically violet, blue or black) image of the writing or printing.

In NCR paper, and its progeny, the color forming chemicals held on the undersurface (back side) of the top (first, original) sheet are typically grouped under the nomenclature "CB", standing for "coated back". The reacting materials on the top surface (front side) of the second (copy) sheet are grouped under the nomenclature "CF", standing for "coated front".

A variation of the CB/CF technology is the "SC", or "Self-Contained" carbonless coating. Herein, the original, first sheet is not coated, and may be plain paper.

The front side of the second, underlying copy sheet is coated with a mixture of CB and CF treatments. The mixture is known as "SC", or "Self-Contained" ooating. Mechanical pressure applied (by writing) through the first sheet causes the CB capsules on the front side of the second sheet to rupture, releasing their dye to react with the CF material on the front side of the second sheet. Examples of this variation are found in checkbooks wherein a copy of the check is disposed directly underlying the original.

Another variation of carbonless copy technology is the "OPAS", or "On Press" coatings. (OPAS is a trademark of Mead) This technology is basically similar to the two part CB/CF technology, but the CB and CF coatings are conveniently applied on press, and are more conducive to spot (patterned) application.

While carbonless paper, such as has been described above, filled a long felt need for replacing carbon paper, there remains a field of usage for which no satisfactory solution has been found for the past 45 years, that is the need for producing a copy of both (front and back) sides of an original form or document. Consider for example, a Federal Tax Return (Internal Revenue Service Form 1040). Information is entered by the taxpayer on both (front and back) sides of the form. Typically, the form is filled out by hand (e.g., written in pen), and the taxpayer must expend additional effort in the making of photocopies of both sides of the form. Alternatively, the information on both sides of the form can be manually transcribed onto both sides of another, duplicate form for recordkeeping purposes. Alternatively, carbon paper could be employed, by carefully positioning a duplicate form under the original form as one side is filled out (with the carbon paper in place therebetween), and then repositioning the form for copying under the original form as the other side is filled out (again, with the carbon paper therebetween). Any of these techniques are entirely unsatisfactory, time consuming, and unnecessary in light of the present invention.

In the aforementioned, copending, commonly-owned U.S. patent applications Ser. Nos. 436,189 and 334,183 there are disclosed techniques for making a two-sided copy of a two-sided original In certain of the many embodiments disclosed therein it is noted that: 1) the original sheet had a CB coating on both sides, which tends to create the possibility of pen skipping when entering on on the original sheet; and/or 2) the CB coating on the original sheet was patterned (applied only to specific areas of the original sheet), which restricted the amount of available area for entering information on the original sheet.

A completely disparate approach to producing an alleged two-sided copy of a document is found in the so-called "two way write" systems. One of such systems comprises a "top" page coated with CF on its back side, a "bottom" page coated with CB on its front side, and an intermediate carbon paper sheet disposed between the top sheet and the bottom sheet with the carbon facing the bottom sheet. Writing "one way", on the front surface of the top sheet, information is copied via the carbon sheet to the front (CB coated) surface of the bottom sheet. The carbon sheet is then removed and the top and bottom sheets are flipped over. Writing the "second way", on the back surface of the bottom sheet, information is copied via the CB front of the bottom sheet to the CF-coated back surface of the top sheet.

Two-way write suffers from a glaring deficiency. As noted above, information is entered (e.g., written) on the front side of the top page and the back side of the bottom page, and is copied to the front side of the bottom page and the back side of the top page, respectively. In other words, each page contains half of an original and half of a copy.

An example of a two-way write type system appears in U.S. Pat. No. 4,000,916, entitled MANIFOLD REPORT FORM AND METHODS FOR USING SAME. Therein it is noted that "the first original imprinting appears on the front side of the top sheet and the second original imprint appears on the back side of the bottom sheet." (See Abstract) Further examples appear in U.S. Pat. Nos. 4,715,620 and 4,762,342, both entitled MANIFOLD FORM ASSEMBLY.

Without in any way disparaging the aforementioned techniques disclosed in commonly-owned U.S. patent application Ser. Nos. 436,189 and 334,183, what is needed is a carbonless form format wherein information entered on both sides of the original sheet is reproduced on the two sides of a copy sheet, while maintaining a clear (non-carbonless coated) original sheet and further enabling the entire area of both sides of the original sheet to be used for entering information.

DISCLOSURE OF THE INVENTION

It is therefore an object of the present invention to provide a technique for producing a two-sided carbonless copy of information written or printed on both sides of an original sheet (paper), such as a form or document.

It is a further object of the present invention to provide a carbonless copy technique for producing a two-sided carbonless copy of information written or printed on both sides of an original sheet.

It is a further object of the present invention to provide a technique for producing a carbonless copy wherein the original and copy pages are self-aligning.

It is a still further object of the invention to provide the benefits of making a two sided copy of both sides of an original document, while maintaining a clear original page and enabling information to be entered on the entire area of the front and back surfaces of the original page.

According to the invention, two-sided "copies" are produced from two-sided "originals" using carbonless copy technology.

In one embodiment of the invention, a single sheet of paper, having a front surface and a back surface, is divided into two portions, an original page and a copy page, by a boundary. The sheet may be folded one way along the boundary so that the original and copy pages are in back-to-back relationship. A separate piece of "magic" paper is inserted between the back surfaces of the original and copy pages and is coated with carbonless CB coating on at least a surface facing the back surface of the copy page. Information entered on the clear (non-carbonless coated) front surface (Side 1) of the original page is reproduced on the carbonless CF-coated back surface of the copy page. The sheet is then folded the other way along the boundary so that the original and copy pages are in front-to-front relationship with each other. The separate piece of paper is inserted between the front surfaces of the original and copy pages and is coated with carbonless CB coating on at least the surface facing the front surface of the copy page. Information entered on the clear back surface of the original page is reproduced on the carbonless CF-coated front surface of the copy page.

Preferably, the boundary is vertical, so that the original and copy pages are side-by-side in their normal orientation. Preferably, the boundary is perforated to facilitate folding and separating the original and copy pages.

Preferably, the separate sheet of "magic" paper inserted between the folded original and copy pages is coated on both its front and back surfaces with carbonless CB coating.

In another embodiment of the invention, a single sheet of paper, having a front surface and a back surface, is divided into three portions, an original page, a copy page and an intermediate "magic" page, by two parallel, spaced-apart boundaries. The sheet may be folded one way along one of the boundaries so that the original and copy pages are in back-to-back relationship. The intermediate "magic" page is folded along another of the boundaries to reside between the back surfaces of the original and copy pages and is coated with carbonless CB coating on its surface facing the back surface of the copy page. Information entered on the clear (non-carbonless coated) front surface (side) of the original page is reproduced on the carbonless CF-coated back surface of the copy page. The sheet is then re-folded, another way along the boundaries, so that the original and copy pages are in front-to-front relationship with each other and intermediate page resides between the front surfaces of the original and copy pages. Again, the intermediate "magic" page is coated with carbonless CB coating on its surface facing the carbonless CF-coated front surface of the copy page. Information entered on the clear back surface of the original page is reproduced on the carbonless CF coated front surface of the copy page.

Preferably, the boundaries are vertical, so that the original, copy and intermediate "magic" pages are side-by-side in their normal orientation. Preferably, the boundary is perforated to facilitate folding and separating the original, copy and intermediate pages.

In this three panel (a single sheet forming the original, copy and intermediate pages) embodiment of the invention, the original page may be one of the end panels, or it may be the middle panel. Further, the intermediate "magic" page may be an end panel or the middle panel.

In all of the above-described embodiments, the CB-coated, separate "magic" sheet or intermediate "magic" page becomes discarded after information is entered on both sides of the original page and reproduced on both sides of the copy page.

In one of the three panel embodiments, shown in FIGS. 5A–5E, the sheet is folded in zig-zag manner so that the back of the original page faces the front of the copy page. Information entered on the front of the original page is reproduced on the front of the copy page, via the intermediate magic page. The sheet is then refolded so that the front of the original page faces the back of the copy page. Information entered on the back of the original page is reproduced via the intermediate magic page onto the back of the copy page.

Other objects, features and advantages of the invention will become apparent in light of the following description thereof.

BRIEF DESCRIPTION OF THE DRAWINGS

FIG. 1A is a top plan view of an embodiment of the carbonless copy paper of the aforementioned U.S. patent application Ser. No. 436,189.

FIG. 1B is a bottom plan view of the carbonless copy paper of FIG. 1A.

FIG. 1C is a cross sectional view of the carbonless copy paper of FIG. 1A, taken on section line IC-lC through FIG. 1A.

FIG. 1D is a perspective view of the carbonless copy paper of FIG. 1A, with the original and copy pages folded in back-toback relationship.

FIG. 1E is a perspective view of the carbonless copy paper of FIG. 1A, with the original and copy pages folded in front-to-front relationship.

FIG. 2A is a perspective view of the carbonless copy form of the present invention, folded one way, for writing on the front side of the original page.

FIG. 2B is a perspective view of the form of FIG. 2A, folded the other (opposite) way, for writing on the back side of the original page.

FIG. 2C is a cross sectional view of the form of FIG. 2A, taken on a line 2C—2C through FIG. 2A.

FIG. 3A is a top plan view of an alternate embodiment of the carbonless copy paper of the present invention.

FIG. 3B is a bottom plan view of the carbonless copy paper of FIG. 3A.

FIG. 3C is a cross sectional view of the carbonless copy paper of FIG. 3A, taken on a line 3C—3C through FIG. 3A.

FIG. 3D is a perspective view of the carbonless copy paper of FIG. 3A, folded one way for entering information on one side of the original page.

FIG. 3E is a perspective view of the carbonless copy paper of FIG. 3A, folded another way for entering information on the other side of the original page.

FIG. 4A is a top plan view of an alternate embodiment of the carbonless copy paper of the present invention.

FIG. 4B is a bottom plan view of the carbonless copy paper of FIG. 4A.

FIG. 4C is a cross sectional view of the carbonless copy paper of FIG. 4A, taken on a line 4C-4C through FIG. 4A.

FIG. 4D is a perspective view of the carbonless copy paper of FIG. 4A, folded one way for entering information on one side of the original page.

FIG. 4E is a perspective view of the carbonless copy paper of FIG. 4A, folded another way for entering information on the other side of the original page.

FIG. 5A is a top plan view of an alternate embodiment of the carbonless copy paper of the present invention.

FIG. 5B is a bottom plan view of the carbonless copy paper of FIG. 5A.

FIG. 5C is a cross sectional view of the carbonless copy paper of FIG. 5A, taken on a line 5C—5C through FIG. 5A.

FIG. 5D is a perspective view of the carbonless copy paper of FIG. 5A, folded one way for entering information on one side of the original page.

FIG. 5E is a perspective view of the carbonless copy paper of FIG. 5A, folded another way for entering information on the other side of the original page.

DETAILED DESCRIPTION OF THE INVENTION

Figure 1A:
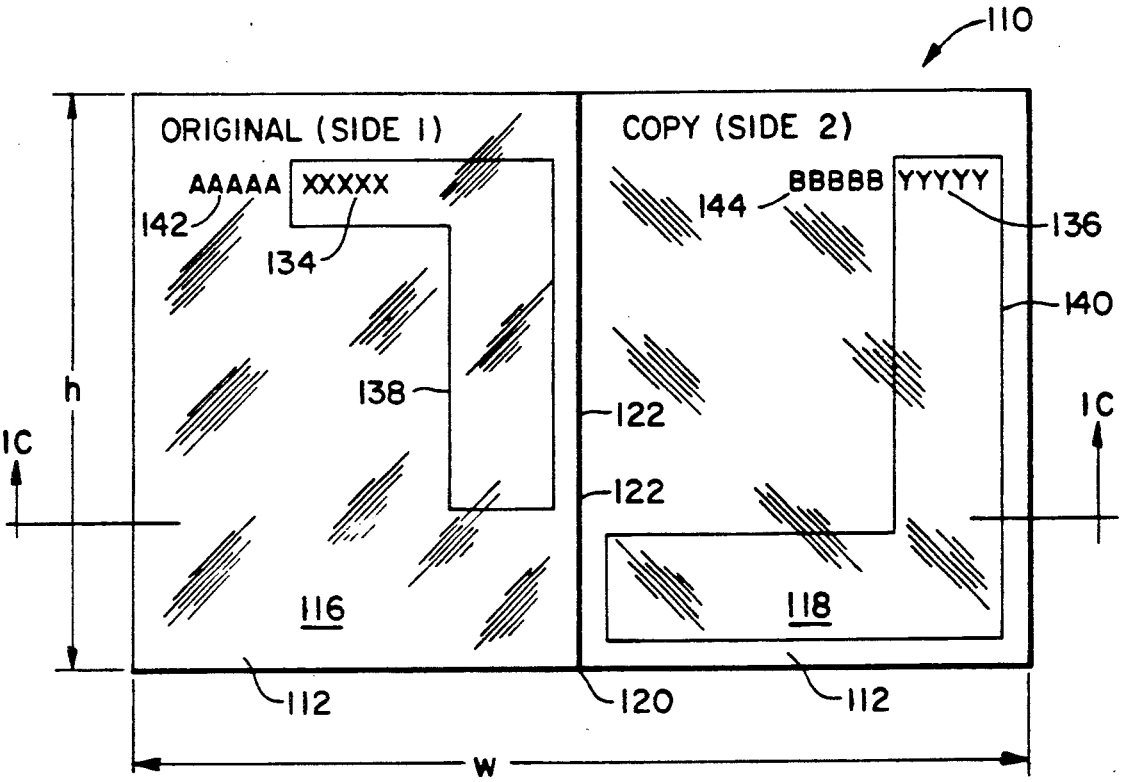
FIGS. 1A-1E

FIG. 1A, 1B, 1C, 1D and 1E show a single sheet of carbonless copy paper 10, as disclosed in the aforementioned copending U.S. patent application No. 436,189. The sheet 10 has a front surface 12 and a back surface 14. By way of example, the height, h, of the sheet is 11 inches, and the overall width, w, of the sheet is 17 inches. The sheet is divided into two side-by-side portions of equal width (e.g., 8½ inches each), a left portion 16 and a right portion 18. The left and right portions 16 and 18 are divided by a boundary 20, which is perforated by a line of perforations 22 to facilitate folding the left and right portions with respect to one another, and to facilitate separation of the left portion from the right portion, as discussed hereinafter. The sheet 10 thus forms two pages; an "original" two-sided page 16 and a "copy" two-sided page 18.

As best viewed in FIG. 1A, the front surface 12 of the original page 16 bears a legend "ORIGINAL (SIDE 1)", and the front surface 12 of the copy page 18 bears a legend "COPY (SIDE 2)".

Figure 1B:
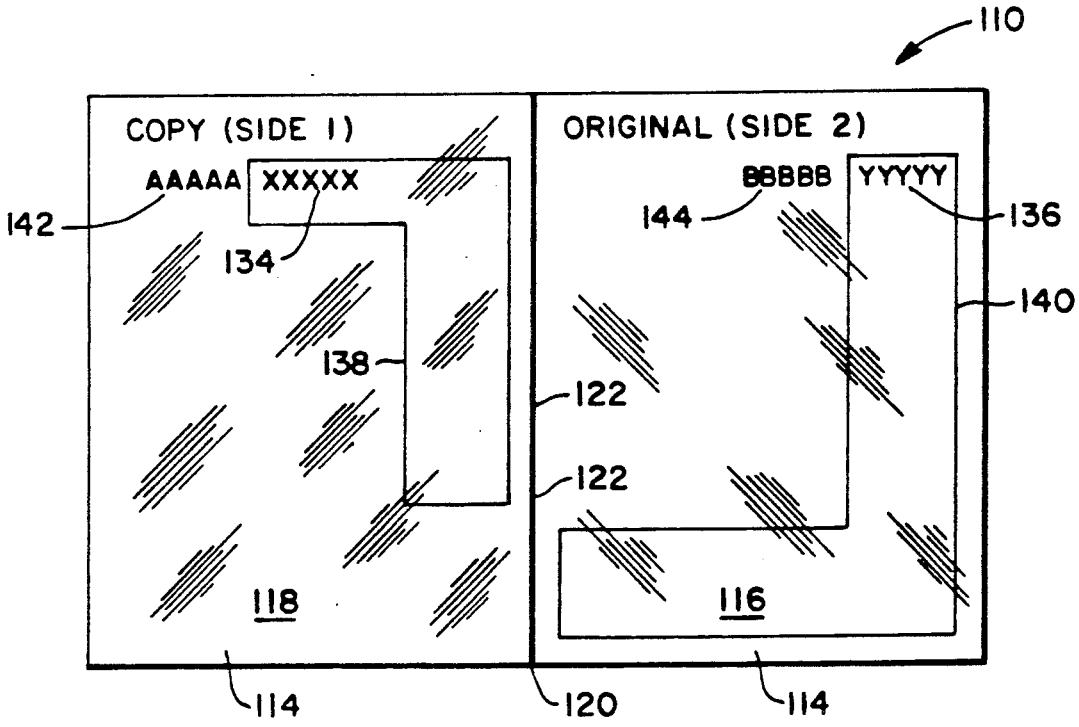

As best viewed in FIG. 1B, the back surface 14 of the original page 16 bears a legend "ORIGINAL (SIDE 2)", and the back surface 14 of the copy page 18 bears a legend "COPY (SIDE 1)". No particular meaning is intended to be ascribed to these legends other than that they are useful in understanding the invention.

Figure 1C:
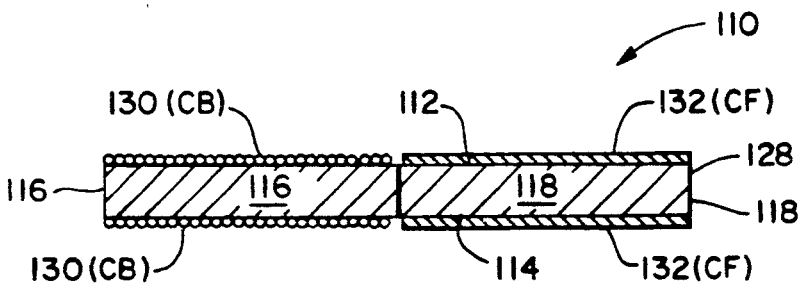

As best viewed in FIG. 1C, the sheet 10 of carbonless copy paper is formed of a base sheet of ordinary paper 28 to which a carbonless CB coating 30 and carbonless CF coating 32 are applied, in the following manner. The front and back surfaces 12 and 14 of the left portion ("original" page) 16 are coated with one part 30 (CB) of a two-part, chemical carbonless copy treatment, and the front and back surfaces 12 and 14 of the right portion ("copy" page) 18 are coated with another, cooperating part 32 (CF) of the two-part, chemical carbonless copy treatment. Generally, the entire front and back surfaces of the left and right portions are coated with CB and CF carbonless copy treatment, respectively, as shown in FIG. 1C.

Throughout the descriptions contained herein, it is assumed that the techniques for applying carbonless coatings such as the CB and CF coatings described herein are well known. There are many suitable products readily available on the marketplace. The chemical composition of exemplary coatings are described in further detail in the aforementioned copending U.S. patent application Ser. No. 436,189.

As disclosed in the aforementioned copending U.S. patent application Ser. No. 436,189, it is beneficial if the carbonless CB and CF treatments stop short, such as by one-tenth of an inch, of the boundary where the pages will be folded. This avoids problems in manufacturing, wherein CB and CF coatings laid down side-by-side may tend to "bleed" together if allowed to come into contact with one another.

Figure 1D:
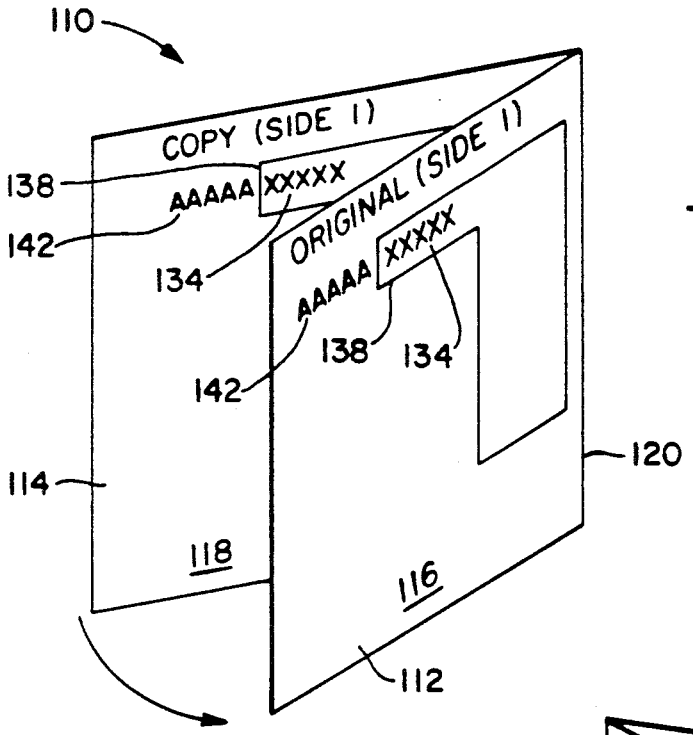

In use, first information 34 ("XXXXX") is printed or written (entered), such as by pen, pencil or impact printer, on the front surface 12 (Side 1) of the original page 16 (see FIG. 1A), and is reproduced on the back surface 14 (Side 1) of the copy page 18 (see FIG. 1B). In order to effect this result, prior to entering the first information 34 on the front surface 12 (Side 1) of the original page 16, the copy page 18 is folded along the boundary 20 10 underneath, back-to-back, and in alignment with the original page 16, as shown in FIG. 1D. The carbonless CB treatment 30 on the back surface 14 (Side 2) of the original page 16 reacts with the carbonless CF treatment 32 on the back surface 14 (Side 1) of the copy page 18 to create the reproduction of the first information 34 on the back surface 14 (Side 1) of the copy page 18. FIG. 1D shows the copy page 18 partially folded beneath the original page 16, in back-to-back relationship therewith.

Figure 1E:
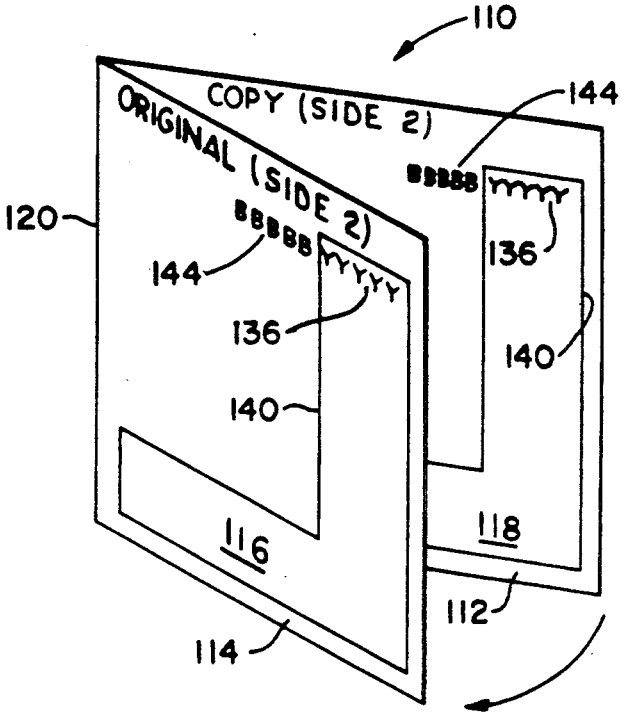

In further use, second information 36 ("YYYYY") is printed or written (entered) on the back surface 14 (Side 2) of the original page 16 (see FIG. 1B), and is reproduced on the front surface 12 (Side 2) of the copy page 18 (see FIG. 1A). In order to effect this result, prior to entering the second information 36 on the back surface 14 (Side 2) of the original page 16, the copy page I8 is folded along the boundary 20 on top of, front-to-front and in alignment with the original page 16, as shown in FIG. 1E. The carbonless CB treatment 30 on the front surface 12 (Side 1) of the original page 16 reacts with the carbonless CF treatment 32 on the front surface (Side 2) 12 of the copy page 18 to create a reproduction of the second information 36 on the front surface 12 (Side 2) of the copy page 18. FIG. 1E shows the copy page 18 partially folded atop the original page 16, in front-to-front relationship therewith.

After the first information 34 has been entered on the front surface 12 (Side 1) of the original page 16 and reproduced on the back surface 14 (Side 1) of the copy page 18, and after the second information 36 has been entered on the back surface 14 (Side 2) of the original page 16 and reproduced on the front surface 12 (Side 2) of the copy page 18, the original and copy pages 16 and 18 may be separated by tearing the sheet 10 along the boundary perforations 22. In this manner, a two-sided copy 18 of a two sided original 16 is produced. This is of particular interest in filling out two-sided forms, such as Federal Income Tax Form 1040.

In the context of filling out preprinted, two-sided forms, information is typically entered in selected areas on each side of the form. As shown in FIG. 1A, a selected area for entering the first information 34 ("XXXXX") on the front surface 12 (Side 1) of the original page 16 is delineated by a preprinted border 38. As shown in FIG. 1B, a selected area for entering the second information 36 ("YYYYY") on the back surface 14 (Side 2) of the original page 16 is delineated by a preprinted border 40. Preferably, as shown, the borders 38 and 40 are preprinted on the copy page 18 so that the copy page 18 will be an exact duplicate of the original page 16. It should be understood that the selected areas for entering the first and second information may be delineated by means other than preprinted borders. Such means would include delineating such areas by differential shading (from the remainder of the page). Federal Income Tax Form 1040 is a good example of such differential shading. Therein, selected ares for entering information are white (the base color of the paper), and the areas where information is not entered (containing preprinted, instructional information) are colored blue.

In further connection with the entering of the first and second information 34 and 36 on the front and back surfaces 12 and 14, respectively, of the original page 16, other matter (other than the preprinted borders 38 and 40) may be preprinted on the original and copy pages 16 and 18. For example, first instructional information 42 ("AAAAA") is preprinted on the front surface 12 (Side 1) of the original page 16 in juxtaposition with the preprinted border 38, and second instructional information 44 ("BBBBB") is preprinted on the back surface 14 (Side 2) of the original page 16 in juxtaposition with the preprinted border 40. Preferably, as shown, the instructional information 42 and 44 is preprinted on the copy page 18 so that the copy page 18 will be an exact duplicate of the original page 16 In the context of forms, such as the aforementioned Federal Income Tax Form 1040, the instructional information 42 and 44 directs the taxpayer to enter particular information 34 and 36 in the respectively juxtaposed selected areas delineated by the borders 38 and 40.

An unusual feature of the two-sided carbonless copying technique, as described with respect to FIGS. 1A through 1E, is that information is entered on a surface of the sheet that has a carbonless copy treatment. Consider the following. When entering the first information 34 ("XXXXX") on the front surface 12 (Side 1) of the original page 16, although it is the carbonless CB treatment 30 on the back surface of the original page 16 that is "operative" in the sense that it reacts with the carbonless CF treatment 32 on the back surface 14 (Side 1) of the copy sheet 18, nevertheless the information to be copied is entered on the front, CB-treated surface 12 of the original page 16. Hence, in the case of the entire front surface 12 of the original page 16 being treated with the carbonless treatment (for reproduction by the back surface 14 thereof), the microencapsulated dye of the carbonless CB treatment 30 on the front surface 12 of the original page 16 may be released. However, it is released without any visible result. Remember, copying (reproduction of information) is only effected when the microencapsulated dye of the carbonless CB treatment 30 on the back surface 14 of the original page 16 reacts with the carbonless CF treatment on the back surface 14 of the copy page 18 which is in intimate, back-to-back contact therewith (when folded thereunder). Hence, the microencapsulated dye of the carbonless CB treatment 30 on the front surface 12 of the original page 16 which is released when entering the first information 34 ("XXXXX") on the front surface 12 (Side 1) of the original page 16 is simply superfluous, and may, at worst, tend to clog the tip of a ball point pen used to enter the first information. Hence, a ball point pen having a non-clogging tip is recommended for entering information, if a ball point pen is the writing instrument of choice. Such a clogging tendency would not be apparent if a pencil were employed for entering the information. A similar situation occurs when entering the second information 36 ("YYYYY") on the back surface 14 (Side 2) of the original page 16. Superfluous microencapsulated dye may be released from the carbonless CB treatment 30 on the back surface 14 of the original page, but would be released without visible effect. More importantly, microencapsulated dye will be released from the carbonless CB treatment 30 on the front surface 12 of the original page 16 onto the front surface 12 (Side 2) of the copy page 18 (folded in front- to-front relationship with the original page 16) to produce a copy of the second information on the front surface 12 (Side 2) of the copy page 18.

Many of the teachings of FIGS. 1A–1E are applicable throughout the following description of the present invention.

FIGS. 2A–2C

Clear Original Paoe

While the superfluous release of microencapsulated dye from the carbonless treatment from the "wrong" (written upon) surface of the original page has been found not to present any serious obstacle to the entering of information on either side of the original page and subsequent reproduction of the information on the copy page, it was disclosed in the aforementioned U.S. patent application Ser. No. 436,189 that it may be advantageous to select particular areas on the front and back surfaces of the original page in which the first and second information is to be entered, and to offset these selected areas so that they are not aligned front-to-back on the original page, and to apply the carbonless CB treatment only to corresponding selected areas on the opposite sides of the original page, in front-to-back alignment therewith. Among other advantages of such a "patterned" application of the carbonless treatment, this would avoid any potential pen-clogging problem.

According to the present invention, the original page is clear of any coating whatsoever. This will avoid any problems, actual or perceived, incident to applying carbonless coating to the original page.

Figure 2A:
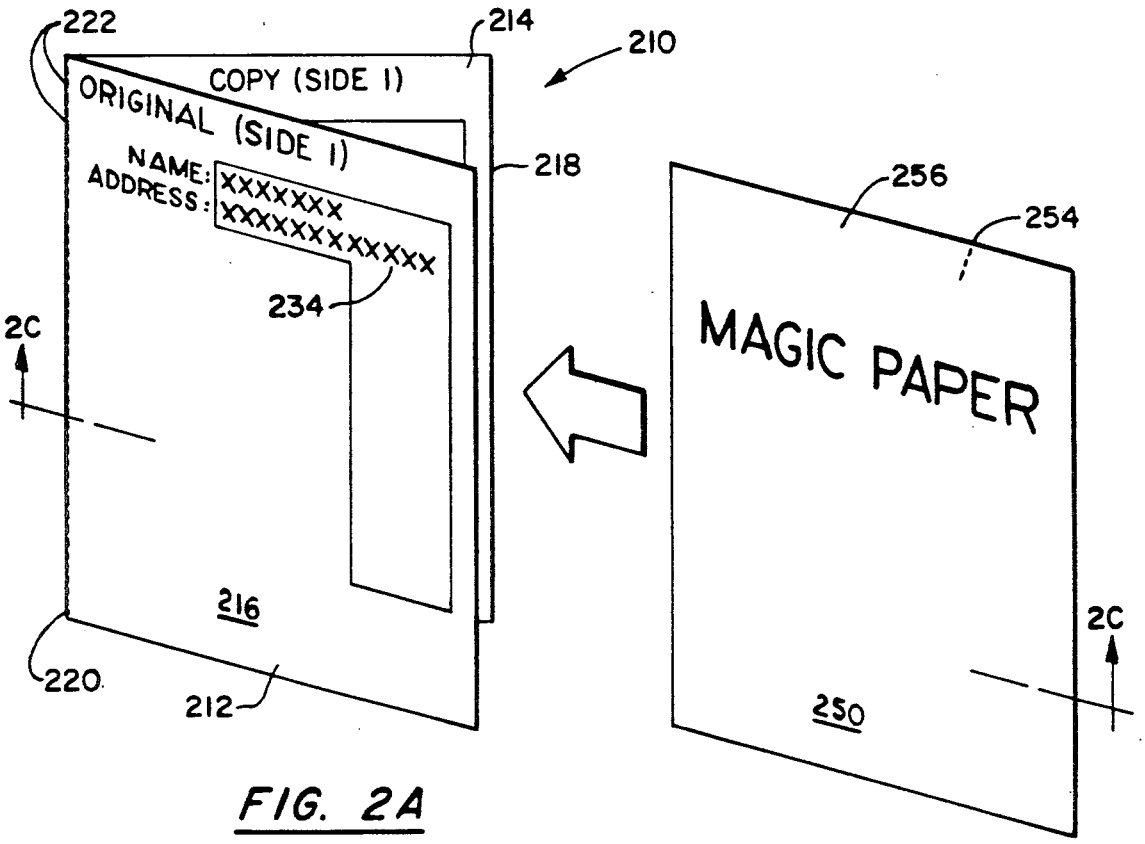
FIGS. 2A-2C
Figure 2B:
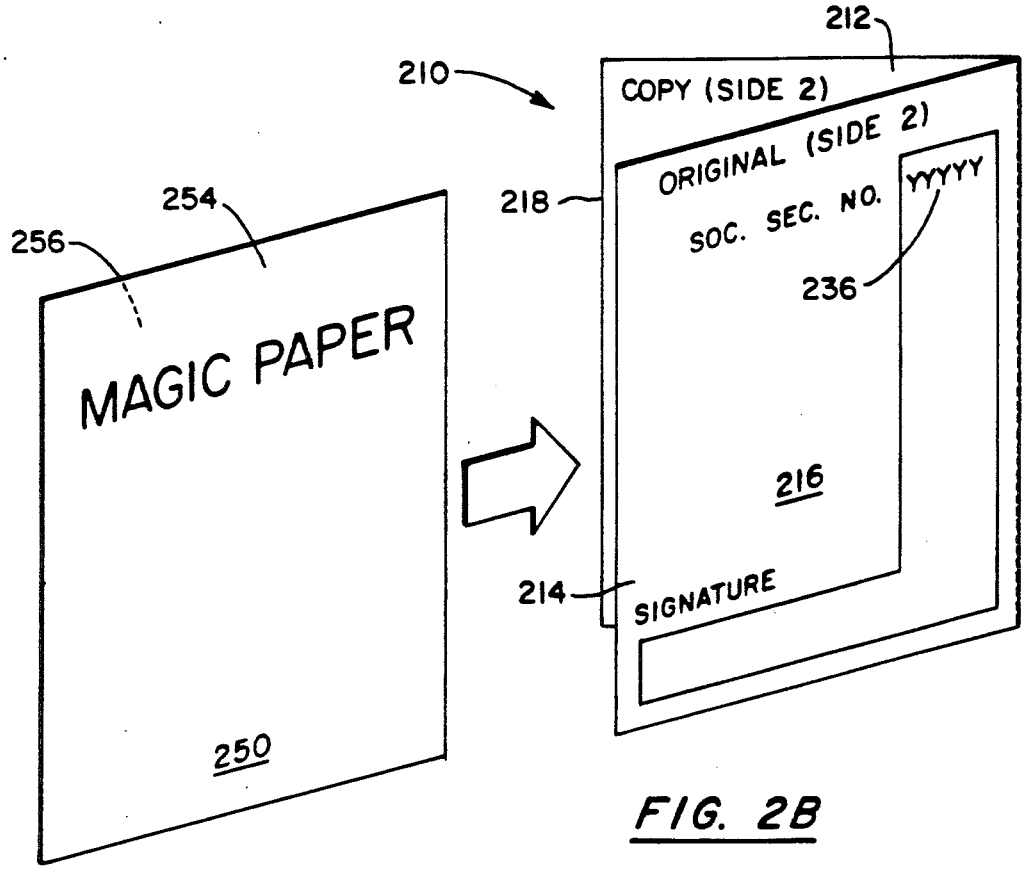
Figure 2C:
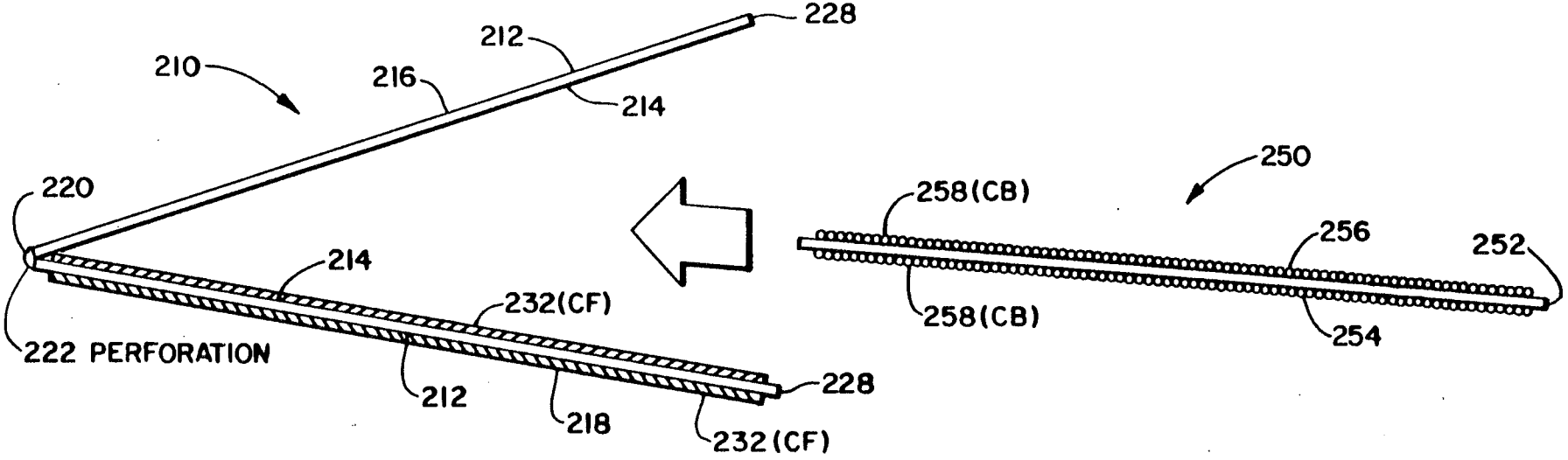

FIGS. 2A–2C show one embodiment of the invention.

A single sheet of paper 210 has a front surface 212 and a back surface 214. By way of example, the sheet has a height "h" of eleven inches and an overall width "w" of seventeen inches. The sheet 210 is divided into two side-by-side portions of equal width (8½ inches wide, each), an "original page" portion 216 and a "copy" page portion 2I8. The original and copy pages 216 and 218 are divided by a boundary 220, which is perforated by a line of perforations 222 to facilitate folding the original and copy pages with respect to one another, and to facilitate separating the original page from the copy page, as described hereinafter.

As best viewed in FIG. 2A, the front surface 212 of the original page 216 bears the legend "ORIGINAL (SIDE 1)", and the back surface 214 of the copy page 218 bears the legend "COPY (SIDE 1)". As best viewed in FIG. 2B, the back surface 214 of the original page 216 bears the legend "ORIGINAL (SIDE 2)", and the front surface 212 of the copy page 218 bears the legend "COPY (SIDE 2)". No particular meaning is intended to be ascribed to these legends, other than that they are useful in understanding the invention.

As best viewed in FIG. 2C, the sheet 210 is formed of a base sheet of ordinary paper 228. A carbonless CF coating 232 is applied to both the front and back surfaces of the copy page 218. The original page 216 remains clear of any carbonless coating.

Whereas in the aforementioned, copending U.S. patent application Ser. No. 436,189, the original page was coated on both sides (front and back surfaces) with a carbonless CB treatment ( see FIG. 1C), in the present invention the original page is devoid of a carbonless coating, and a separate sheet of "magic" paper is used to transfer information entered on both sides of the original page to corresponding two sides of the copy page, as described hereinafter.

Returning to FIG. 2A, the original and copy pages are folded one way, in back-to-back relationship, along the boundary (border) 20 so that the back surface 214 of the original page 216 is facing the back surface 214 of the copy page 218. Information ("XXXXX") 234 entered on the front side 212 of the original page 216 will be reproduced on the back surface 214 of the copy page 218, as follows.

A sheet of "magic" paper 250 is inserted, as indicated by the arrow, between the original and copy pages to effect reproduction of information 234 entered on the front surface of the original page onto the back surface of the copy page. This is accomplished as follows. The magic paper 250 is formed of a sheet of ordinary paper 252 having two opposing surfaces 254 and 256. The sheet 252 is generally of the same size as the original page, and is coated on the surface 254 with carbonless CB treatment 258. When inserted between the original and copy pages, as shown in FIG. 2A, the carbonless CB treatment 258 will be in contact with the carbonless CF treatment 232 on the back surface of the copy page. Information 234 entered on the front surface of the original page will, by pressure, be reproduced on the back surface of the copy page, in perfect alignment therewith.

Returning to FIG. 2B, the original and copy pages are folded another, opposite way, in front-to-front relationship, along the boundary 220 so that the front surface 212 of the original page 216 is facing the front surface 212 of the copy page 218. Information ("YYYYY") 2364 entered on the back side 214 of the original page 216 will be reproduced on the front surface 212 of the copy page 218, as follows.

The sheet of "magic" paper 250 is inserted, as indicated by the arrow, between (intermediate) the original and copy pages to effect reproduction of the information 236 entered on the back surface of the original page onto the front surface of the copy page. This is accomplished in one of two ways. Either the magic paper 250 is inserted so that the CB-coated surface 254 faces the front CF-coated surface 212 of the copy page 218, or the opposite surface 256 of the magic paper is also coated with carbonless CB treatment 258. The latter is preferred and shown.

When the magic paper 250 is inserted between the original and copy pages, as shown in FIG. 2B, the carbonless CB treatment 258 on the surface 256 will be in contact with the carbonless CF treatment 232 on the front surface 212 of the copy page 218. The information 236 entered on the back surface of the original page will, by pressure, be reproduced on the front surface of the copy page, in perfect alignment therewith.

After entering information 346 and 236 on the front and back surfaces of the original page 216, which information is reproduced on the back and front surfaces, respectively, of the copy page 218, the magic paper 250 can be discarded. Or, one sheet of magic paper 250 can be used in connection with multiple carbonless forms 200.

It is important to distinguish the use of magic paper from the use of carbon paper. Simply put, two sided carbon paper would not work. For instance, if a two-sided (carbonized both sides) carbon paper were inserted between the original and copy pages, when information was entered on the original page it would not only be reproduced on the copy page, but would also be reproduced in reverse on the opposite surface of the original page. This would not only be senseless, but would also deface the opposite side of the original page, rendering it and the concept of copying both sides useless.

Preferably, for ease of discriminating between the original and copy pages, throughout the various embodiments described herein, the original page and copy pages are dissimilarly colored, Typically, the original page is not colored at all and is left white, and the copy page is colored pink, buff, canary or another color contrasting with white. Further, the "magic" page can be dissimilarly colored from either of the original or copy pages. Such dissimilar coloration of copy pages is well known, and can be applied as a foundation (base) coloring in the paper itself, or could be a dye mixed in with the carbonless copy treatment. The original page (216) can also have a non-white base color, such as blue, as in the case of Federal Income Tax Form 1040, wherein the areas for entering information are left white, uncolored.

The chemistry of chemical carbonless copy technology, preprinting instructional information on forms, providing differential base coloring on the paper and perforating the paper are all well known, and are advantageously employed in all of the embodiments of the present invention. Throughout the descriptions of the various embodiments of this invention, it should be understood that any suitable CB and CF coatings could be employed.

The utility of this invention in the context of creating a copy of a two-sided form is manifestly evident. For instance, it would no longer be necessary to obtain a photocopy of a two-sided form in order to retain a copy thereof. Nor would it be necessary to manually reproduce on a copy (typically a separate, second original) of the form the information entered on the original. Nor would it be necessary to carefully position carbon paper between two copies (one original and one copy) of a form.

The utility of this invention extends beyond creating a two-sided copy of a both sides of a form. It has utility in reproducing information entered on both sides of any (original) page. This would include invoices and the like, which contain limited preprinted information, as well as completely blank (with no preprinted markings or information) original pages, such as letter stationary. Warranty cards, subscription renewal forms and the like would all benefit from the teachings of the present invention. Carbonless copy treatment is known to be effective on paper up to 45 pounds (card stock).

One of the extraordinary benefits of the present invention is that the copy page (218) is self-aligning with the original page (216) since it is well retained in alignment therewith by the 15 "living hinge" formed by the boundary (border) 220 for folding the copy page under and over the original page (as described above).

It should be understood that, although the original and copy pages have been described as being formed from a single sheet of paper, the technology disclosed herein is applicable, for instance, to two individual sheets of paper—one of which is clear of any carbonless coating (the "original" page) and the other of which is coated on its front and back surfaces with carbonless CF treatment (the "copy" page). The hinge effect of the single sheet with perforated boundary 220 is, however, much more convenient in terms of ensuring that an original page is kept in alignment therewith during the entering of information. It should be understood, however, that a "single" sheet of paper, such as that forming the original and copy pages 216 and 218, could be formed by joining two individual sheets of paper, such as by cross-web gluing.

FIGS. 3-3E

Alternate Embodiment

FIGS. 3A-3E show an alternate embodiment of the invention. Whereas in the previous embodiment (FIGS. 2A-2C), the "magic" paper was provided as a separate sheet, in this embodiment the magic paper is incorporated into a single sheet with the original and copy pages.

The FIGS. show a single-sheet carbonless form 310. The sheet 310 has a front surface 312 and a back surface 314, and is divided into three equally-sized panels (or pages) 316, 317 and 318 by two parallel, spaced-apart boundaries 320, 321. Each of the boundaries is provided with a line of perforations 322 to facilitate folding and separating the various panels, as described hereinafter. The overall height "h" of the sheet 310 is typically eleven inches, and its overall width "w" is typically 25½ inches. In this manner, the three panels 316, 317 and 318 are each 8½ by 11 inches. These particular height and width dimensions are not critical features of the present invention.

In this embodiment, one of the end panels 316 serves as the "original" page, and is "clear", in other words not coated with a carbonless coating. The other end panel 318 is the intermediate "magic" page and is coated on both its front and back surfaces with a carbonless CB treatment 330. The remaining, middle panel 317 serves as the "copy" page, and is coated on its front and back surfaces with a carbonless CF treatment 332 for reproducing information entered on the original page 316.

Figure 3A:
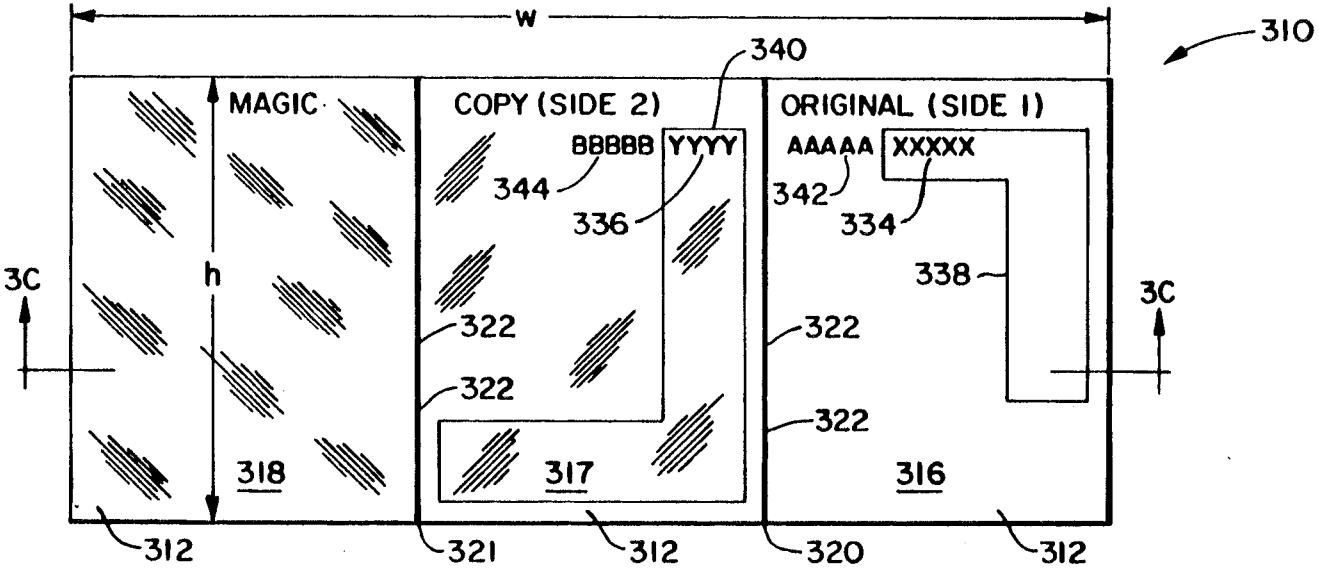
FIGS. 3A-3E
Figure 3B:
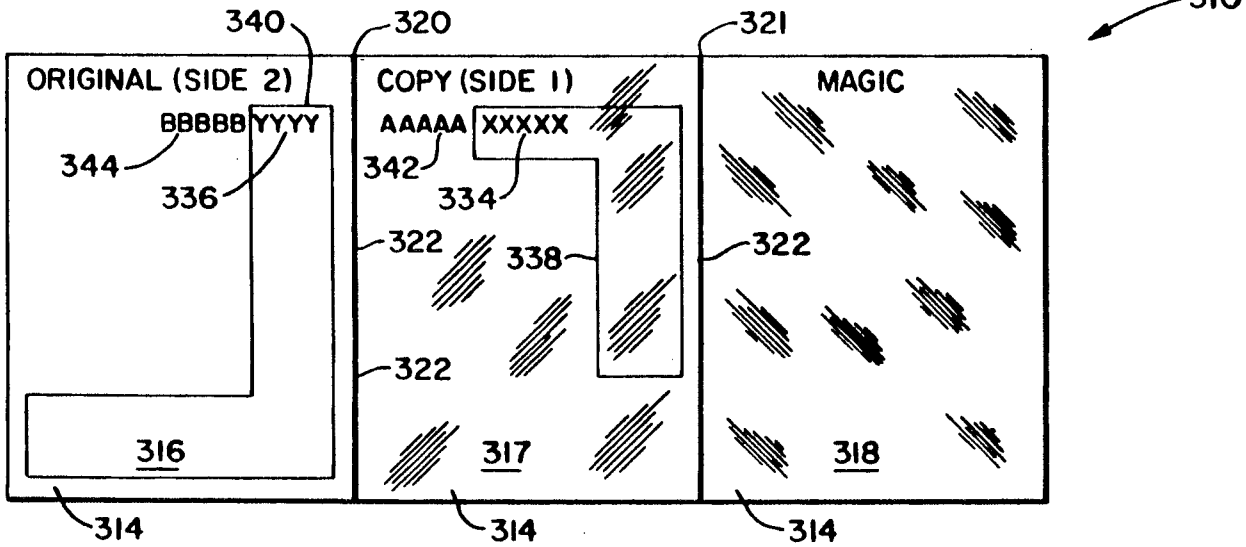

As shown in FIG. 3A, the front surface of the original page is imprinted with the legend "ORIGINAL (SIDE 1)" and the front surface 312 of the copy page 317 is imprinted with the legend "COPY (SIDE 2)". Similarly, as shown in FIG. 3B, the back surface 314 of the original page 316 is imprinted with the legend "ORIGINAL (SIDE 2)" and the back surface of the copy page 317 is imprinted 15 with the legend "COPY (SIDE 1)". These legends are presented to assist in understanding the drawings, and do not form a critical feature of the invention.

Figure 3C:
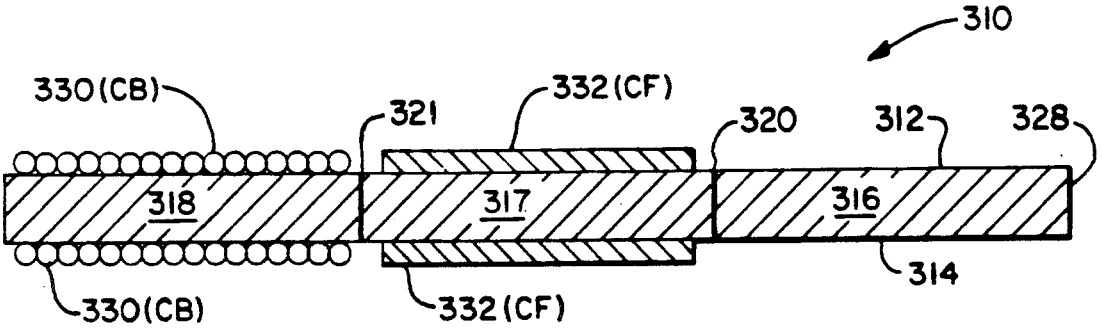

As shown in FIG. 3C, the carbonless form 310 is formed of a piece of paper 328, to which the aforementioned carbonless CB and CF coatings 330 and 332, respectively, have been applied to the "magic" page 318 and the copy page 317, respectively. As shown therein, the front and back surfaces of the magic page 318 are fully coated with carbonless CB treatment 330, and the front and back surfaces of the copy page 317 are fully coated with carbonless CF treatment 332. Preferably, the aforementioned carbonless CB and CF treatments stop just short (e.g., extend to within 1/16 of an inch) of the contiguous border 321 between the magic and copy pages, so that the coreactive CB and CF treatments do not contact each other during the manufacturing process.

Figure 3D:
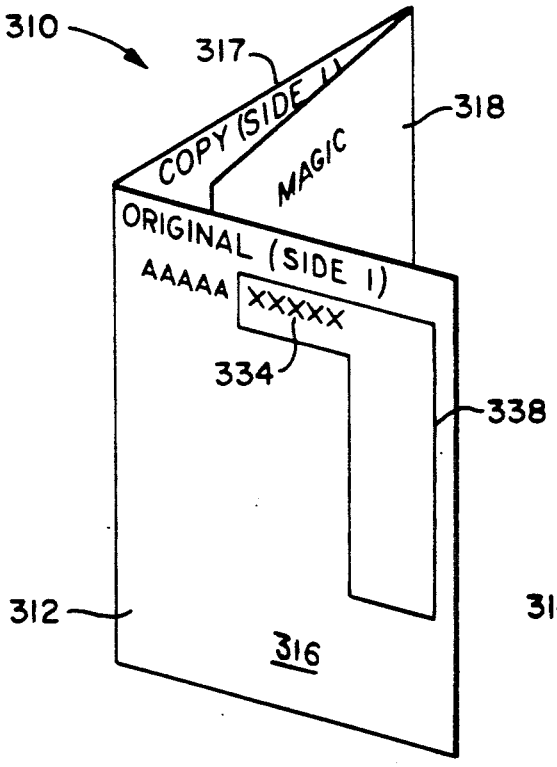

Turning to FIG. 3D, the form 310 is folded so that the front surface 312 of the original page 316 is exposed for entering information ("XXXXX") 334 in an area 338. The back surface 314 of the original page faces the back surface 314 of the copy page 317, and the magic page 318 is interposed between (intermediate) the back of the original page and the back of the copy page. In this manner, information 334 entered on the front surface 312 of the original page 316 is reproduced on the back surface 314 of the copy page 317 by the coreaction of the CB coating 330 on the back surface 314 of the magic page 318 which is in intimate contact with the CF coating on the back surface 314 of the copy page 317. Since the back surface 314 of the original page 316 is not coated, the carbonless CB coating 330 on the front surface 312 of the magic page 318 will not cause any imaging on the back surface 314 of the original page 316.

Figure 3E:
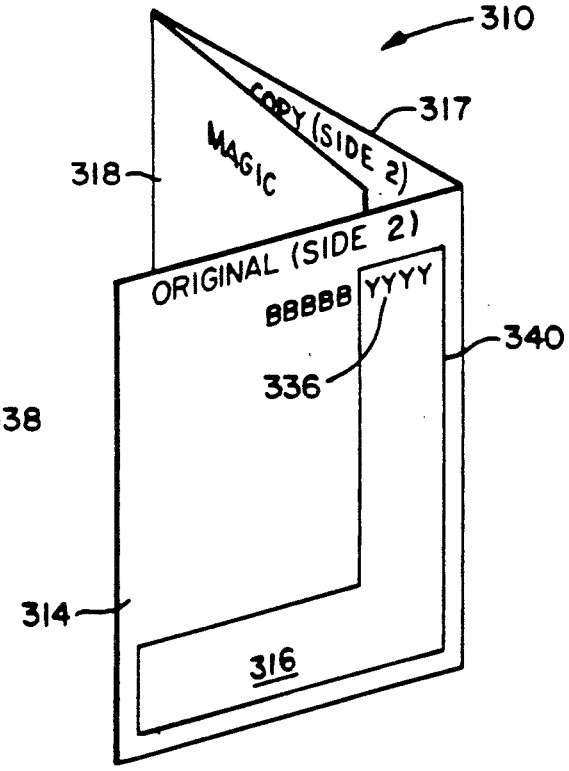

Turning to FIG. 3E, the form 310 is refolded so that the back surface (SIDE 2) 314 of the original page 316 is exposed for entering information ("YYYYY") 336 in an area 340. The front surface 312 of the original page faces the front surface 312 of the copy page 317, and the magic page 318 is interposed between (intermediate) the front of the original page and the front of the copy page. In this manner, information 336 entered on the back surface 314 of the original page 316 is reproduced on the front surface 312 of the copy page 317 by the coreaction of the CB coating 330 on the front surface 312 of the magic page 318 which is in intimate contact with the CF coating on the front surface 312 of the copy page 317. Since the front surface 312 of the original page 316 is not coated, the carbonless CB coating 330 on the back surface 314 of the magic page 38 will not cause any imaging on the front surface 312 of the original page 316.

The information 334 and 336 may be entered anywhere on the front and back surfaces, respectively, of the original page 316, and will be reproduced on the back and front surfaces, respectively, of the copy page 317. The areas 338 and 340 for entering this information are included for illustrative purposes, and do not form a critical feature of the invention. Similarly, the form may be provided with instructional legends 342 and 344, adjacent the areas 338 and 340, respectively, but again this is for illustrative purposes only.

As in the previous embodiment (FIGS. 2A–2C), the folding technique provides perfect registration and alignment between the original and copy pages. The perforated boundaries 320 and 321 facilitate the folding and consequent separation of the original, copy and magic pages from the sheet 310. After use, the magic page 318 is discarded.

It should be appreciated, throughout the various embodiments of the invention disclosed herein, that although the delineation of the single sheet of paper into original and copy pages is a highly beneficial feature of the invention, insofar as folding the original, copy and intermediate pages into various orientations while maintaining perfect registration is concerned, the invention is applicable to producing a two-sided copy of both sides of an original using separate sheets of paper. Further, the various embodiments of the two-sided form of this invention can be manufactured without any legends, markings or the like, which have been included for illustrative purposes only.

FIGS. 4A–4E

Alternate Embodiment

FIGS. 4A–4E show an alternate embodiment of the invention. Whereas in the previous embodiment (FIGS. 3A–3E), the "original" page was disposed on an end of the single sheet, in this embodiment the original page is the middle panel of the sheet. The "magic" and "copy" pages are disposed at opposite ends of the sheet.

The Figures show a single-sheet carbonless form 410. The sheet 410 has a front surface 412 and a back surface 414, and is divided into three equally-sized panels (or pages) 416, 417 and 418 by two parallel, spaced-apart boundaries 420, 421. Each of the boundaries is provided with a line of perforations 422 to facilitate folding and separating the various panels, as described hereinafter. Again, the overall height "h" of the sheet 410 is 25½ inches. In this manner, the three panels 416, 417 and 418 are each 8½ by 11 inches. Again, the height and width dimensions are not critical features of the present invention.

In this embodiment, the middle panel 417 serves as the "original" page, and is "clear", in other words not coated with a carbonless coating. One end panel 416 is the intermediate "magic" page and is coated on both its front and back surfaces with a carbonless CB treatment 430. The other end panel 318 serves as the "copy" page, and is coated on its front and back surfaces with a 15 carbonless CF treatment 432 for reproducing information entered on the original page 417.

Figure 4A:
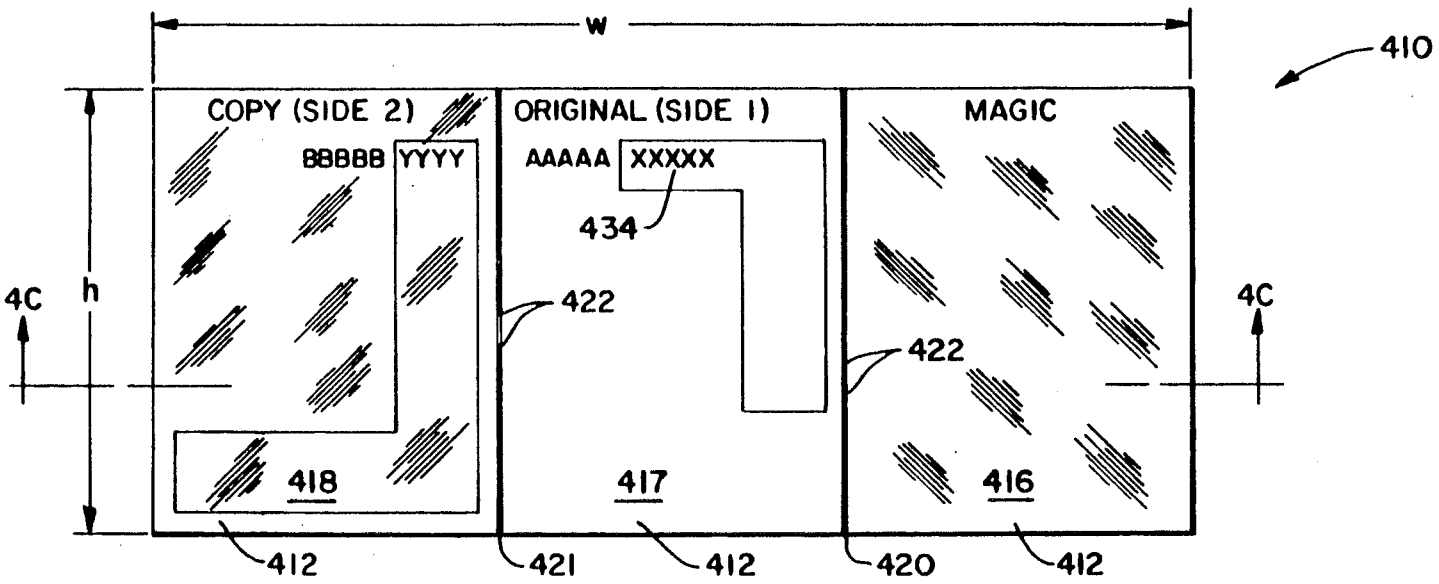
FIGS. 4A-4E
Figure 4B:
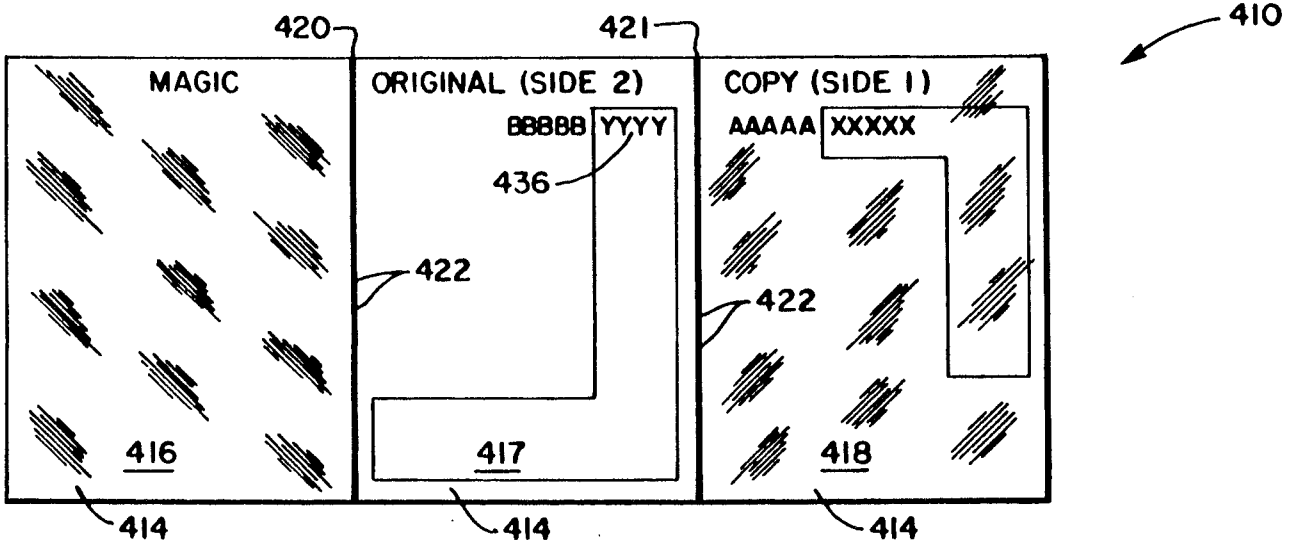
Figure 4C:
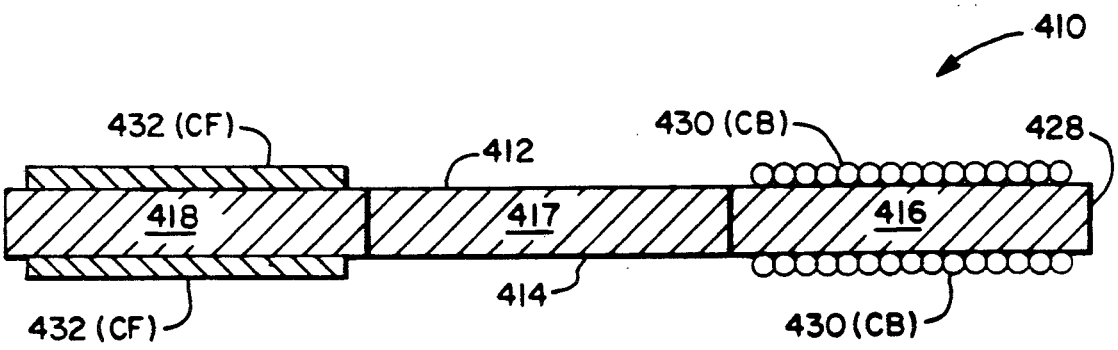

As shown in FIG. 4A, the front surface 412 of the original page 417 is imprinted with the legend "ORIGINAL (SIDE 1)" and the front surface 412 of the copy page 418 is imprinted with the legend "COPY (SIDE 2)". Similarly, as shown in FIG. 4B, the back surface 414 of the original page 417 is imprinted with the legend "ORIGINAL (SIDE 2)" and the back surface 414 of the copy page 418 is imprinted with the legend "COPY (SIDE 1)". These legends are presented to assist in understanding the drawings, and do not form a critical feature of the invention.

As shown in FIG. 3C, the carbonless form 410 is formed of a piece of paper 428, to which the aforementioned carbonless CB and CF coatings 430 and 432, respectively, have been applied to the "magic" page 416 and the copy page 418, respectively. As shown therein, the front and back surfaces of the magic page 416 are fully coated with carbonless CB treatment 430, and the front and back surfaces of the copy page 418 are fully coated with carbonless CF treatment 432. In this embodiment, since the magic and copy pages do not have a contiguous border (compare border 321 in FIGS. 3A–3E), it is not necessary that the carbonless coatings stop just short of their respective borders with the uncoated (clear) original page 417.

Figure 4D:
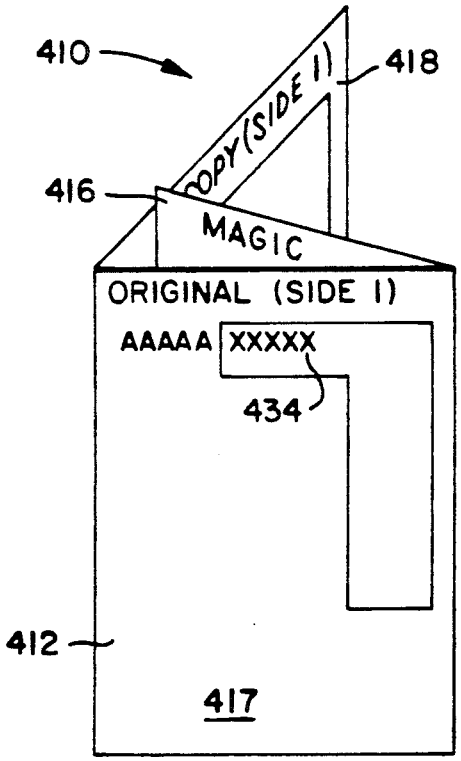

Turning to FIG. 4D, the form 410 is folded so that the front surface 412 of the original page 417 is exposed for entering information ("XXXXX") 434. The back surface 414 of the original page 417 faces the back surface 414 of the copy page 418, and the magic page 416 is interposed between (intermediate) the back of the original page and the back of the copy page. In this manner, information 434 entered on the front surface 412 of the original page 417 is reproduced on the back surface 414 of the copy page 418 by the coreaction of the CB coating 430 on the front surface 412 of the magic page 416 which is in intimate contact with the CF-coated back surface 414 of the copy page 418. Since the back surface 414 of the original page 417 is not coated, the carbonless CB coating 430 on the back surface 414 of the magic page 46 will not cause any imaging on the back surface 414 of the original page 417.

Figure 4E:
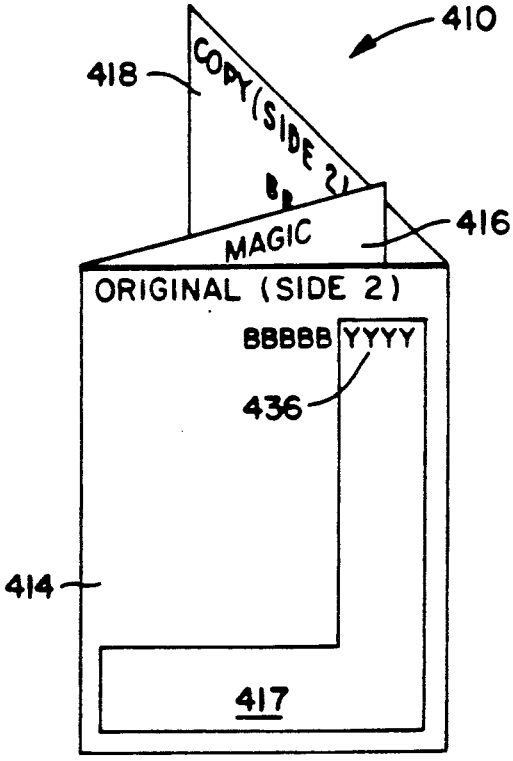

Turning to FIG. 4E, the form 410 is refolded so that the back surface (SIDE 2) 414 of the original page 417 is exposed for entering information ("YYYYY") 436.

The front surface 412 of the original page 417 faces the front surface 412 of the copy page 418, and the magic page 416 is interposed between (intermediate) the front 412 of the original page 417 and the front 412 of the copy page 418. In this manner, information 436 entered on the back surface 414 of the original page 417 is reproduced on the front surface 412 of the copy page 418 by the coreaction of the CB coating 430 on the back surface 414 of the magic page 416 which is in intimate contact with the CF coating on the front surface 412 of the copy page 418. Since the front surface 412 of the original page 417 is not coated, the carbonless CB coating 430 on the front surface 412 of the magic page 416 will not cause any imaging on the front surface 412 of the original page 417.

Again, the information 434 and 436 may be entered anywhere on the front and back surfaces, respectively, of the original page 417, and will be reproduced on the back and front surfaces, respectively, of the copy page 418. Areas (unnumbered) for entering this information are shown, for consistency throughout the drawings, but do not form a critical feature of the invention. Similarly, the form may be provided with instructional legends "AAAAA" and "BBBBB" adjacent to these areas, but again this is for illustrative purposes only.

As in the previous embodiments, the folding technique provides perfect registration and alignment between the original and copy pages. The perforated boundaries 420, 421 facilitate the folding and consequent separation of the original, copy and magic pages from the sheet 410. After use, the magic page 416 is discarded.

It will be noted that the embodiments of FIGS. 3A–3E and 4A–4E are similar in that the magic page 318 and 416 is one of the end panels and is folded inward between the original and copy pages.

FIGS. 5A–5E

Alternate Embodiment

FIGS. 5A–5E show an further alternate embodiment of the invention. Whereas in the previous embodiment (FIGS. 4A–4E), the "original" page was the middle panel of the sheet, in this embodiment the original page is disposed at one end of the sheet. However, unlike the previous embodiment of FIGS. 3A–3E, the "magic" page is disposed adjacent to the original page, i.e., in the middle of the sheet. The copy page is disposed at an opposite end of the sheet.

The Figures show a single-sheet carbonless form 510. The sheet 510 has a front surface 512 and a back surface 514, and is divided into three equally-sized panels (or pages) 516, 517 and 518 by two parallel, spaced-apart boundaries 520, 521. Each of the boundaries is provided with a line of perforations 522 to facilitate folding and separating the various panels, as described hereinafter. Again, the overall height "h" of the sheet 510 is typically eleven inches, and its overall width "w" is typically 25½ inches. In this manner, the three panels 516, 517 and 518 are each 8½ by 11 inches. Again, height and width dimensions are not critical features of the present invention.

In this embodiment, the end panel 516 serves as the "original" page, and is "clear", in other words not coated with a carbonless coating. The middle panel 517 is the intermediate "magic" page and is coated on both its front and back surfaces with a carbonless CB treatment 530. The other end panel 518 serves as the "copy" page, and is coated on its front and back surfaces with a carbonless CF treatment 532 for reproducing information entered on the original page 516.

Figure 5A:
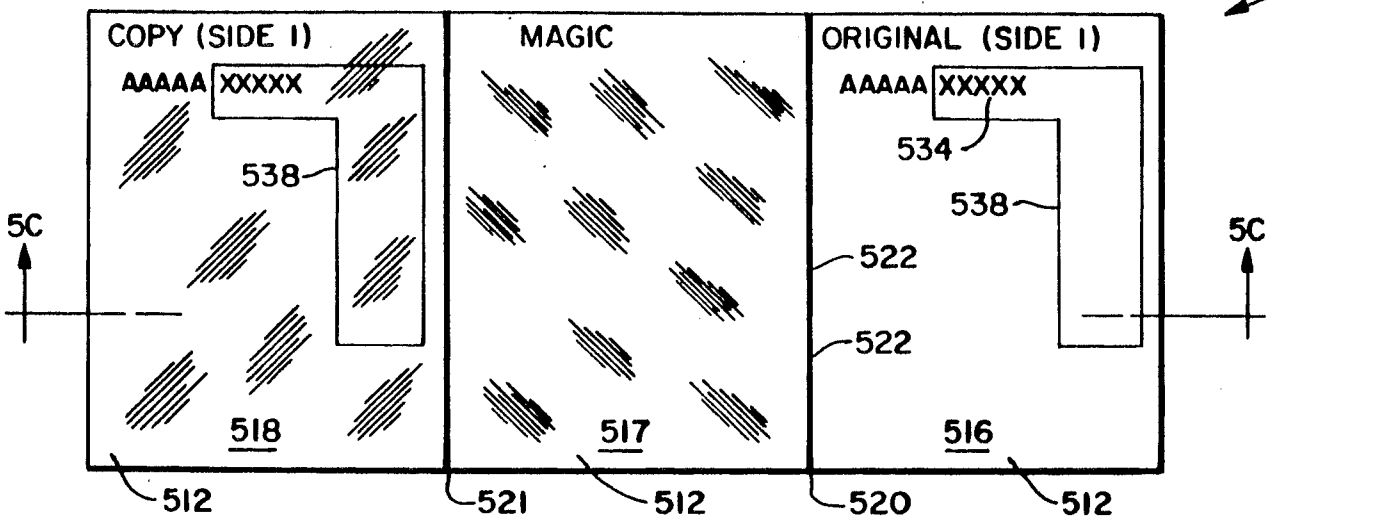
FIGS. 5A-5E
Figure 5B:
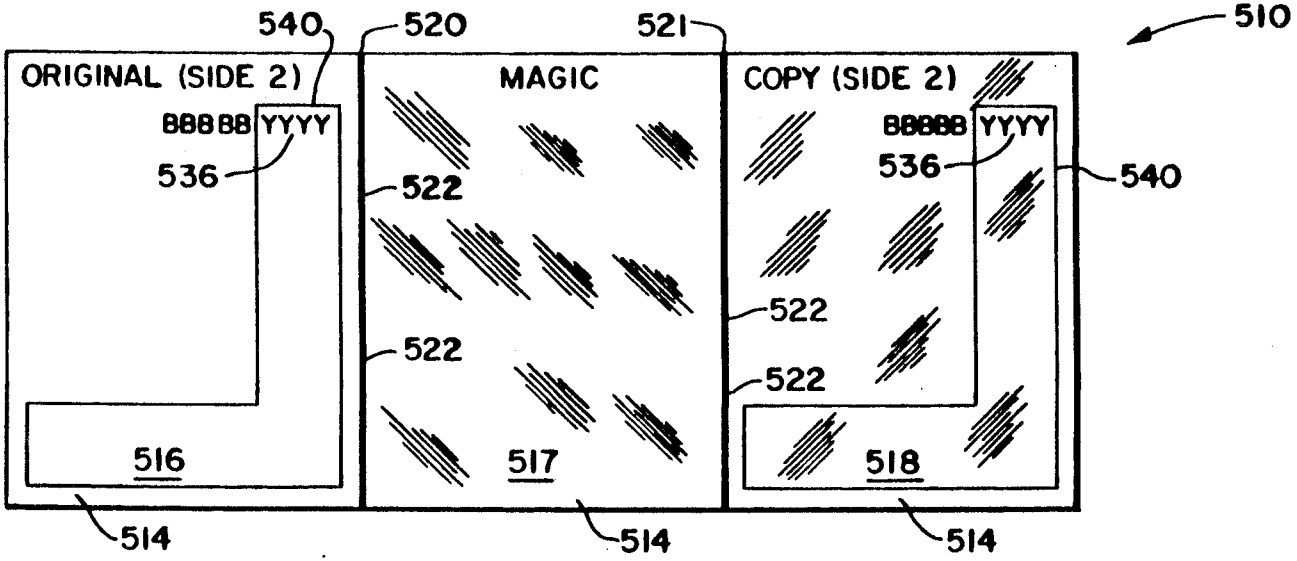

As shown in FIG. 5A, the front surface 512 of the original page 516 is imprinted with the legend "ORIGINAL (SIDE 1)" and the front surface 512 of the copy page 518 is imprinted with the legend "COPY (SIDE 1)". This is a slight departure from the previous embodiments, and is necessitated by the folding technique, discussed hereinafter. Similarly, as shown in FIG. 5B, the back surface 514 of the original page 516 is imprinted with the legend "ORIGINAL (SIDE 2)" and the back surface 514 of the copy page 518 is imprinted with the legend "COPY (SIDE 2)". These legends are presented to assist in understanding the drawings, and do not form a critical feature of the invention.

Figure 5C:
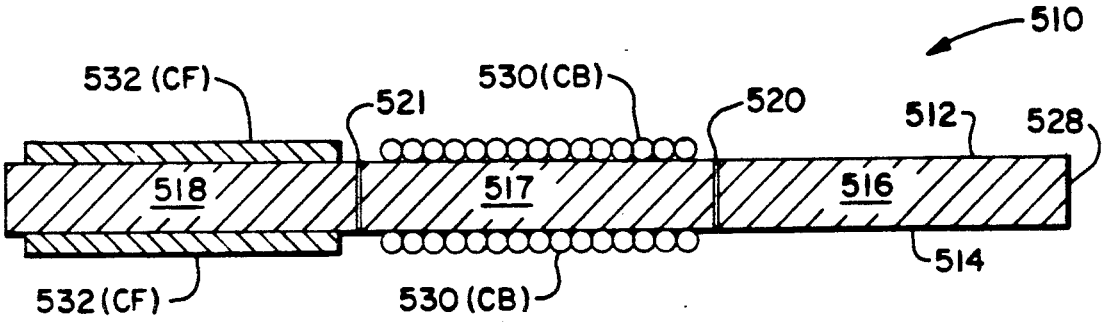

As shown in FIG. 5C, the carbonless form 510 is formed of a piece of paper 528, to which the aforementioned carbonless CB and CF coatings 530 and 532, respectively, have been applied to the "magic" page 517 and the copy page 518, respectively. As shown therein, the front and back surfaces of the magic page 517 are fully coated with carbonless CB treatment 530, and the front and back surfaces of the copy page 518 are fully coated with carbonless CF treatment 532. As in the embodiment of FIGS. 3A–3E, it is preferred that these coatings on the magic and copy pages stop just short of their contiguous boundary 521 so that they do not "bleed" during the manufacturing process.

Figure 5D:
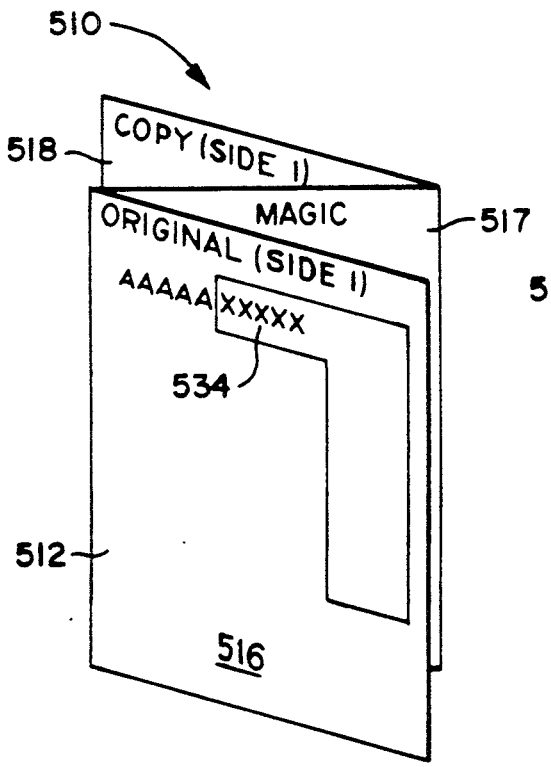

Turning to FIG. 5D, the form 510 is folded in a zigzag manner so that the front surface 512 of the original page 516 is exposed for entering information ("XXXXX") 534. The back surface 514 of the original page faces the front surface 512 of the copy page 518, and the magic page 517 is interposed between (intermediate) the back of the original page and the front of the copy page. In this manner, information 534 entered on the front surface 512 of the original page 516 is reproduced on the front surface 512 of the copy page 518 by the coreaction of the CB coating 530 on the front surface 512 of the magic page 517 which is in intimate contact with the CF coating on the front surface 512 of the copy page 518. Since the back surface 514 of the original page 516 is not coated, the carbonless CB coating 530 on the back surface 514 of the magic page 517 will not cause any imaging on the back surface 514 of the original page 516.

Figure 5E:
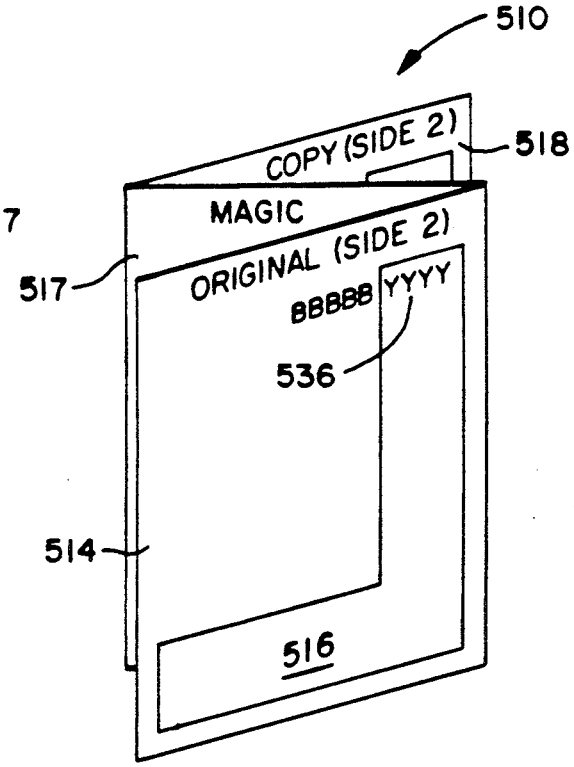

Turning to FIG. 5E, the form 510 is refolded, again in zigzag manner, so that the back surface (SIDE 2) 514 of the original page 516 is exposed for entering information ("YYYYY") 536. The front surface 512 of the original page 516 faces the back surface 514 of the copy page 518, and the magic page 517 is interposed between (intermediate) the front 512 of the original page 516 and the back 514 of the copy page 518. In this manner, information 536 entered on the back surface 514 of the original page 516 is reproduced on the back surface 514 of the copy page 518 by the coreaction of the CB coating 430 on the back surface 514 of the magic page 517 which is in intimate contact with the CF coating on the back surface 514 of the copy page 518. Since the front surface 512 of the original page 516 is not coated, the carbonless CB coating 430 on the front surface 512 of the magic page 517 will not cause any spurious imaging on the front surface 512 of the original page 516. This avoidance of spurious imaging on the opposite side (opposite from the side upon which information is being entered) of the original page is a critical feature of the invention, and would not be possible with two-sided carbon paper.

Again, the information 534 and 536 may be entered anywhere on the front and back surfaces, respectively, of the original page 516, and will be reproduced in register on the front and back surfaces, respectively, of the copy page 518. Areas (unnumbered) 10 for entering this information are shown, for consistency throughout the drawings, but do not form a critical feature of the invention. Similarly, the form may be provided with instructional legends "AAAAA" and "BBBBB" adjacent these areas, but again this is for illustrative purposes only.

As in the previous embodiments, the folding technique provides perfect registration and alignment between the original and copy pages. The perforated boundaries 520, 521 facilitate the folding and consequent separation of the original, copy and magic pages from the sheet 510. After use, the magic page 517 is discarded.

The embodiments of FIGS. 3A-3E and 5A-5E are similar in that the copy and magic pages are adjacent, and share a contiguous border. However, the folding technique of FIGS. 5A-5E differs from that of the other embodiments.

What is claimed is:

1. Carbonless form comprising:

a single sheet of paper having a front surface and a back surface and two portions, an original portion for entering information on both sides, and a copy portion for receiving images of the information entered on both sides of the original portion, said sheet foldable one way so that the original and copy portions are in back-to-back relationship with each other for entering first information on one side of the original portion and imaging the first information onto one side of the copy portion, and foldable another way so that the original and copy portions are in front-to-front relationship with each other for entering second information on an opposite side of the original portion and imaging the second information onto an opposite side of the copy portion;

an other, separate sheet of paper, having a front furface and a back surface, and adapted to be inserted between the original and copy portons when the sheet is folded either way, and having a carbonless CB treatment applied to at least one of the front and back surfaces thereof; and carbonless CF coating applied to both sides of the copy portion;

wherein the original portion is free of CF coating.

2. Carbonless form according to claim 1, wherein:

a boundary between the two portions is perforated to facilitate separation of the original portion from the copy portion after entering information on both sides of the original portion.

3. Carbonless form according to claim 1, wherein:

a boundary between the two portions is vertical and divides the paper horizontally into two, side-by-side, original and copy portions.

4. Carbonless form according to claim 1, wherein:

the other, separate sheet is coated on both its front and back surfaces with a carbonless CB treatment.

5. Carbonless form according to claim 1, wherein:

the original portion is white;

the copy portion is dissimilarly colored from the original portion; and the other, separate sheet is dissimilarly colored from both the original portion and the copy portion.

6. Carbonless form comprising:

a single sheet of paper having two ends, a front surface and a back furface and having three portions, an original portion, a copy portion and an intermediate portion, said sheet foldable one way so that the original and copy portions are in back-to-back relationship with each other and the intermediate portion resides between the original and copy portions, and foldable another way so that the original and copy portions are in front-to-front relationship with each other and the intermediate portion resides between the original and copy portions;

carbonless CB coating applied to the front and back surfaces of the intermediate portion; and carbonless CF treatment applied to the front and back surfaces of the copy portion.

7. Carbonless form according to claim 6, wherein:

boundaries between the three portions are perforated to facilitate separation of the intermediate and copy portions from the original portion.

8. Carbonless form according to claim 7, wherein:

the boundaries are vertical and divide the paper horizontally into three, side-by-side, original, copy and intermediate portions.

9. Carbonless form according to claim 6, wherein:

the original portion is disposed at one end of the sheet of paper;

the copy portion is disposed in the middle of the sheet of paper; and the intermediate portion is disposed at the opposite end of the sheet of paper.

10. Carbonless form according to claim 6, wherein:

the original portion is disposed in the middle of the sheet of paper;

the copy portion is disposed at one end of the sheet of paper; and the intermediate portion is disposed at the other end of the sheet of paper.

11. Carbonless form according to claim 6, wherein:

the original portion is disposed at one end of the sheet of paper;

the copy portion is disposed at the other end of the sheet of paper; and the intermediate portion is disposed in the middle of the sheet of paper.

12. Carbonless form according to claim 6, wherein:

the original portion is white;

the copy portion is dissimilarly colored from the original portion; and the other, separate sheet is dissimilarly colored from both the original portion and the copy portion.

13. A method of reproducing information entered on both sides of an original page onto both sides of a copy page comprising:

providing a single sheet of paper having at least an original panel for entering information on both sides and a copy panel coated with CF on both sides for receiving images of the information entered on both sides of the original panel, wherein the original panel is clear of CF;

providing a transfer panel which is coated on at least one of its front and back surfaces with a carbonless CB treatment;

interposing the transfer panel between the original and copy panels and entering first information on the front of the original panel;

reorienting the orginal and copy pages;

re-interposing the transfer panel between the original panel and the copy panel and entering second information on the back of the original page.

14. A method according to claim 13, wherein:

the original and copy panels are formed from a single sheet of paper; and the transfer panel is formed from a separate sheet of paper.

15. A method according to claim 13, wherein:

the original, copy and intermediate panels are formed from a single sheet of paper.

16. Carbonless form consisting essentially of:

a single sheet of paper having a front surface and a back surface and divided by a boundary into two portions, an original portion and a copy portion, said sheet foldable one way along the boundary so that the original and copy portions are in back-to-back relationship with each other and foldable another way along boundary so that the original and copy portions are in front-to-front relationship with each other;

an other, separate sheet of paper, having a front surface and a back surface, and adapted to be inserted between the original and copy portions when the sheet is folded either way, and having a carbonless CB treatment applied to at least one of the front and back surfaces thereof; and carbonless CF treatment applied to the front and back surfaces of the copy portion.

* * * * *